US012503661B2

(12) United States Patent
Casey et al.

(10) Patent No.: US 12,503,661 B2
(45) Date of Patent: Dec. 23, 2025

(54) ADDITIVE COMPOSITIONS FOR FUEL OILS

(71) Applicant: INFINEUM INTERNATIONAL LIMITED, Milton Hill (GB)

(72) Inventors: Abby Casey, Oxford (GB); Chris Stubbs, Didcot (GB)

(73) Assignee: Infineum International Limited, Linden, NJ (US)

( * ) Notice: Subject to any disclaimer, the term of this patent is extended or adjusted under 35 U.S.C. 154(b) by 0 days.

(21) Appl. No.: 18/809,733

(22) Filed: Aug. 20, 2024

(65) Prior Publication Data

US 2025/0084332 A1 Mar. 13, 2025

(30) Foreign Application Priority Data

Sep. 8, 2023 (EP) ..... 23196244

(51) Int. Cl.

| | |
|---|---|
| ***C10L 1/19*** | (2006.01) |
| ***C10L 1/02*** | (2006.01) |
| ***C10L 1/2383*** | (2006.01) |
| ***C10L 1/24*** | (2006.01) |

(52) U.S. Cl.

CPC ..... *C10L 1/191* (2013.01); *C10L 1/02* (2013.01); *C10L 1/2383* (2013.01); *C10L 1/2475* (2013.01); *C10L 2230/08* (2013.01)

(58) Field of Classification Search

CPC ..... C10L 1/191; C10L 1/02; C10L 1/2383; C10L 1/2475; C10L 2230/08; C10L 10/08; C10L 2200/0438; C10L 2230/20; C10L 2300/20; C10L 2300/30; C10L 1/14

See application file for complete search history.

(56) References Cited

U.S. PATENT DOCUMENTS

| | | | |
|---|---|---|---|
| 6,255,262 | B1 | 7/2001 | Keenan et al. |
| 2010/0031559 | A1 | 2/2010 | Burgazli et al. |

FOREIGN PATENT DOCUMENTS

| | | | | |
|---|---|---|---|---|
| RU | 2639301 | C2 | 12/2017 | |
| WO | WO-9936387 | A1 * | 7/1999 | ..... C07C 69/28 |

OTHER PUBLICATIONS

EPO Form 1507N Search Report.

* cited by examiner

*Primary Examiner* — Taiwo Oladapo
(74) *Attorney, Agent, or Firm* — Robert A. Migliorini

(57) ABSTRACT

The invention relates to fuel oil compositions comprising an ester of an alkyl neo-monocarboxylic acid having a total number of from 5 to 30 carbon atoms and an aliphatic acyclic (C2 to C18) alkanol having a total number of from 2 to 18 carbon atoms and a total number of from 2 to 8 hydroxyl groups, wherein the aliphatic acyclic ($C_2$ to $C_{18}$) alkanol includes one or more alkyl chain(s) and each of said one or more alkyl chain(s) may optionally be interrupted by one or more oxygen atom(s), and to associated fuel additive compositions and uses of fuel additives.

38 Claims, No Drawings

ADDITIVE COMPOSITIONS FOR FUEL OILS

PRIORITY

This application claims priority to European Patent application EP23196244, filed in the European Patent Office on Sep. 8, 2023, which is herein incorporated by reference in its entirety.

FIELD OF THE INVENTION

This invention relates to additive(s) and/or additive composition(s) and to low-sulphur content fuel oil compositions including said additive and/or additive composition(s) with improved properties, for example middle distillate fuel oils such as diesel fuels, kerosene and jet fuels and also biofuels, especially diesel fuels.

Suitably, the invention, although not exclusively, relates to additive(s) and/or additive composition(s) for low-sulphur content fuel oil(s) to improve the lubricity and/or electrical conductivity properties of the low-sulphur content fuel oil(s). Suitably, the invention further provides a low-sulphur content fuel oil composition comprising the additive/additive composition, which fuel oil composition may exhibit improved lubricity and/or reduced engine wear and/or improved electrical conductivity properties. Accordingly, the invention provides the use of an additive and/or additive composition to improve the lubricity and/or electrical conductivity properties of a low-sulphur content fuel oil. Still further, the invention provides an additive and/or additive composition having improved low temperature properties (e.g. at or below-5° C.), such as improved reduced low temperature viscosity, which facilitates ease of use, handleability and reduced transportation costs when the additive is used in cold climates. Suitably, although not exclusively, the low-sulphur content fuel oil is a middle distillate fuel oil, preferably a diesel fuel.

BACKGROUND OF THE INVENTION

In the early 1990s, concerns regarding environmental pollution prompted legislation which mandated fuel producers to produce fuel oils with lower sulphur contents. The sulphur content of fuel oils such as diesel fuel, heating oil and kerosene has been successively reduced to lower and lower levels and in Europe, the maximum sulphur level mandated by the standard EN590 is now 0.001% by weight.

One consequence of the refining processes employed to reduce diesel fuel sulphur and aromatic contents is a reduction in the electrical conductivity of the fuel. The insulating properties of low-sulphur content fuel oils represent a potential hazard to refiners, distributors and customers due to the potential for static charge accumulation and discharge. Static charges can occur during pumping and especially filtration of the fuel oil, the release of this charge accumulation as a spark constituting a significant risk in highly flammable environments. Such risks are minimised during fuel processing and handling through appropriate earthing of fuel lines and tanks combined with the use of anti-static additives. These anti-static additives do not prevent the accumulation of static charges but enhance their release to the earthed fuel lines and vessels thereby controlling the risk of sparking. A number of such additives are in common usage and are available commercially. One of the most commonly used anti-static additives is a two-component mixture of a polysulfone and a polymeric polyamine reaction product as disclosed for example in U.S. Pat. No. 3,917,466. Although effective, such anti-static additives (e.g. STADIS) are relatively expensive.

A further consequence of the refining processes employed to reduce diesel fuel sulphur and aromatic contents is a reduction in the ability of the fuel oil to lubricate the engine, such as the injection system of the engine so that, for example, the fuel injection pump of the engine may fail relatively early in the life of an engine. Failure may occur in fuel injection systems such as high-pressure rotary distributors, in-line pumps and injectors. The problem of poor lubricity in low-sulphur content diesel fuel oils is likely to be exacerbated by future engine developments aimed at further reducing emissions, which will have more exacting lubricity requirements than present engines. For example, the advent of high-pressure unit injectors is anticipated to increase the fuel oil lubricity requirement. Similarly, poor lubricity can lead to wear problems in other mechanical devices dependent for lubrication on the natural lubricity of fuel oil.

Lubricity additives for fuel oils have been described in the art. For example, WO 94/17160 describes an additive which comprises an ester of a carboxylic acid and an alcohol wherein the acid has from 2 to 50 carbon atoms and the alcohol has one or more carbon atoms. Glycerol monooleate is specifically disclosed for example.

U.S. Pat. No. 3,287,273 describes lubricity additives which are reaction products of a dicarboxylic acid and an oil soluble glycol. The acid is typically predominantly a dimer of unsaturated fatty acids such as linoleic or oleic acid, although minor proportions of monomer may also be present. Only alkane diols or oxa-alkane diols are specifically suggested as the glycol reactant.

However, the use of prior art lubricity additive(s) in fuel oils, especially in low-sulphur content fuel oils, may present other technical problem(s). For example, the viscosity of prior art lubricity additive(s) may increase significantly with corresponding decreases in temperature below 20° C. Suitably, under field conditions a fuel oil is typically subjected to different temperature cycles, for example in cold climates a fuel oil may be stored at low ambient temperatures, e.g. at temperatures of −5° C. and below. At such a low ambient temperature known lubricity additive(s) is typically highly viscous which makes it difficult to handle (e.g. pump the additive), transport, store and treat a fuel oil with additive, particularly with neat additive.

A partial solution to the problem of the highly viscous nature of a lubricity additive at low ambient temperature is to supply the lubricity additive in the form of a dilute suspension and/or solution for metering into the fuel oil. Suitably, the suspension and/or solution may comprise significantly less than 50 wt % lubricity additive on an active ingredient basis with the balance being an inert organic solvent. However, this approach significantly increases costs associated with transportation, supply and storage of the lubricity additive and necessitates higher top treat rates of lubricity additive composition to the fuel oil to obtain the required performance attributes.

Further, it has been found that known lubricity additive(s) may inhibit dissipation of electrostatic charge from a fuel oil by an antistatic additive and/or decrease the electrical conductivity of a fuel oil which includes such an antistatic additive. Suitably, it has been found that the ability/effectiveness of an antistatic additive to dissipate electrostatic discharge from a fuel oil may deteriorate over time when the antistatic agent is used in combination with a known lubricity additive(s). Suitably, the electrical conductivity of a fuel oil which includes a combination of known lubricity additive and antistatic additive may decrease significantly over time, potentially to a limit that is below required minimum specification limits. Suitably, such problems are more pronounced in low-sulphur content fuel oils, as low-sulphur content fuel oils typically have a lower inherent electrical conductivity than corresponding higher sulphur-content counterparts.

Suitably, the use of a lubricity additive in combination with an anti-static agent in a low-sulphur content fuel oil may present various problems, for example: an unwanted build-up of electrostatic charge and/or a reduction in the electrical conductivity of the treated fuel oil, especially after an extended period of time (e.g. during storage of the treated fuel oil); a reduction in effectiveness/ability of the anti-static agent to dissipate electrostatic charge, especially after a prolonged period of time; and/or the provision of a treated fuel oil which not only initially meets required electrical conductivity specifications but also remains within such specification limits after an extended period of time (e.g. during and after a 28 day period, for example during storage). A proposed solution to these problems has been to over treat the fuel oil with an initial excess of the relatively more expensive anti-static additive to provide a treated fuel oil having an electrical conductivity far in excess of that required by minimum specification limits (for example, ASTM D975 Standard Specification for Diesel Fuel requires a minimum conductivity of 25 $pSm^{-1}$ at the point of delivery) in an attempt to mitigate the inevitable reduction in electrical conductivity of the treated fuel oil over time. However, such a proposal is uneconomical, it may not provide a treated fuel oil having a predictable electrical conductivity at a particular time point, and it may not guarantee the provision of a treated fuel oil, particularly a treated low-sulphur content fuel oil, having the required minimum electrical conductivity specification at a particular time point (e.g. after a 28 day period, for example due to storage).

The present invention seeks to solve one or more of said technical problems associated with a low-sulphur content fuel oil.

Suitably, the invention seeks to improve the inherent reduced lubricity performance of a low-sulphur content fuel oil by providing an additive and/or additive composition for use with a low-sulphur content fuel oil to increase the lubricity performance of the low-sulphur content fuel oil.

Suitably, the invention seeks to provide an additive for use in a low-sulphur content fuel oil, wherein the additive has a relatively low viscosity, particularly when compared to known additive(s), at temperatures below 20° C., suitably at or below 10° C., suitably at or below 5° C., suitably at or below 0° C., suitably at or below −5° C., to facilitate ease of use, handleability (e.g. pumping the additive), transportation, storage and treating a fuel oil with the additive, particularly with neat additive, at such temperatures. Suitably, the relative reduced viscosity of the additive further may permit the provision and use of a concentrated additive composition comprising a relatively high amount of additive active ingredient concentration (e.g. greater than or equal to 80 mass % additive on an active ingredient basis) and typically reduced amount of inert diluent.

Suitably, the invention seeks to provide an additive and/or additive composition for use in a low-sulphur content fuel oil, wherein the additive and/or additive composition when used in combination with an anti-static additive enables the provision of a low-sulphur content fuel oil composition having an electrical conductivity which meets at least required minimum electrical conductivity specification(s), for example at least an electrical conductivity of 25 $pSm^{-1}$ which is the minimum conductivity required by ASTM D975 Standard Specification for Diesel Fuel at the point of delivery, particularly after an extended period of time (e.g. after 28 days) following treatment of the low-sulphur content fuel oil with the additive and/or additive composition.

Suitably, the invention seeks to provide an additive and/or additive composition for use in a low-sulphur content fuel oil, wherein the additive and/or additive composition when used in combination with an anti-static additive enables the provision of a low-sulphur content fuel oil composition having a substantially constant electrical conductivity for an extended period of time, for example a period of 28 days, following treatment of the low-sulphur content fuel oil with the additive and/or additive composition in combination with antistatic additive.

Suitably, the invention seeks to provide an additive and/or additive composition for use in a low-sulphur content fuel, wherein the additive and/or additive composition when used in combination with an anti-static additive does not significantly reduce the effectiveness/ability of the anti-static additive to discharge electrostatic charge from the fuel oil when measured over an extended period of time (e.g. a period of 28 days).

Suitably, the invention seeks to provide an additive and/or additive composition for use in a low-sulphur content fuel oil in combination with an anti-static additive, to enhance the lubricity performance of the fuel oil and provide a fuel oil composition having an electrical conductivity which meets at least the required minimum electrical conductivity specification(s), for example as required by ASTM D975 Standard Specification for Diesel Fuel at the point of delivery, particularly for an extended period of time (e.g. a period of 28 days) following treatment of the low-sulphur content fuel oil with the additive and/or additive composition.

Suitably, the invention seeks to provide an additive and/or additive composition for use in a low-sulphur content fuel oil in combination with an anti-static additive, to enhance the lubricity performance of the fuel oil and provide a fuel oil composition having a substantially constant electrical conductivity for an extended period of time (e.g. a period of 28 days).

SUMMARY OF THE INVENTION

Thus, according to a first aspect, the present invention provides a fuel oil composition comprising a major amount of a middle distillate fuel oil having a sulphur content of 0.2% by weight or less, and a minor amount of a fuel oil additive (A) comprising:

an ester of an alkyl neo-monocarboxylic acid having a total number of from 5 to 30 carbon atoms, as defined and identified herein, and an aliphatic acyclic ($C_2$ to $C_{18}$) alkanol having a total number of from 2 to 18 carbon atoms and a total number of from 2 to 8 hydroxyl groups, as defined and identified herein, wherein said aliphatic acyclic ($C_2$ to $C_{18}$) alkanol comprises one or more alkyl chain(s) and each of said one or more alkyl chain(s) may optionally be interrupted by one or more oxygen atom(s).

Suitably, the fuel oil additive (A) may be present in the fuel oil composition in an amount of greater than or equal to 1, suitably greater than or equal to 2, suitably greater than or equal to 3, suitably greater than or equal to 4, suitably greater than or equal to 5, suitably greater than or equal to 10, suitably greater than or equal to 50, parts per million by mass, on an active ingredient basis, based on the total mass of the fuel oil composition.

Suitably, the fuel oil additive (A) may be present in the fuel oil composition in an amount of less than or equal to 1000, suitably less than or equal to 750, suitably less than or equal to 500, suitably less than or equal to 400, parts per million by mass, on an active ingredient basis, based on the total mass of the fuel oil composition.

In an embodiment, the fuel oil composition of the first aspect of the invention further includes an anti-static additive (B), as defined and identified herein, present in an effective minor amount. Suitably, the anti-static additive (B) facilitates electrostatic discharge from the fuel oil composition. Suitably, the anti-static additive (B), when present, may comprise a two-component mixture of a polysulfone and a polymeric polyamine reaction product, as defined and identified herein.

Suitably, the anti-static additive (B), when present, may be present in the fuel oil composition in an amount of greater than or equal to 0.1, suitably greater than or equal to 0.2, suitably greater than or equal to 0.3, suitably greater than or equal to 0.4, suitably greater than or equal to 0.5, parts per million by mass, on an active ingredient basis, based on the total mass of the fuel oil composition.

Suitably, the anti-static additive (B), when present, may be present in the fuel oil composition in an amount of less than or equal to 10, suitably less than or equal to 7.5, suitably less than or equal to 5, suitably less than or equal to 4, parts per million by mass, on an active ingredient basis, based on the total mass of the fuel oil composition.

Suitably, it has been found that the fuel oil additive (A) when used as an additive in a middle distillate fuel oil having a sulphur content of 0.2% by weight or less may improve the lubricity performance of said middle distillate fuel oil. Suitably, the improvement in lubricity performance may be evidenced by a reduction in wear of the components of the fuel supply system of an engine during operation of the engine. Suitably, said fuel oil additive (A) may be referred to as a lubricity additive, and an additive composition comprising said fuel oil additive (A) may be referred to as a lubricity additive composition.

Thus, according to a second aspect, the present invention provides the use of a fuel oil additive (A), as defined and identified in the first aspect, as an additive, in an effective minor amount, in a middle distillate fuel oil having a sulphur content of less than or equal 0.2 weight %, based on the total weight of the middle distillate fuel oil, to enhance the lubricity performance of the fuel oil (i.e. in comparison to the middle distillate fuel not including the fuel oil additive (A)).

Thus, according to a third aspect, the present invention provides a method of enhancing the lubricity performance of a middle distillate fuel oil having a sulphur content of less than or equal 0.2 weight %, based on the total weight of the middle distillate fuel oil, which comprises adding to said fuel oil an effective minor amount of said fuel oil additive (A), as defined and identified in the first aspect, to enhance lubricity performance.

Thus, according to a fourth aspect, the present invention provides the use of a fuel oil additive (A), as defined and identified in the first aspect, as an additive, in an effective minor amount, in a middle distillate fuel oil having a sulphur content of less than or equal 0.2 weight %, based on the total weight of the middle distillate fuel oil, to reduce the wear rate in a fuel supply system of a combustion apparatus employing said middle distillate fuel oil (i.e. in comparison to the middle distillate fuel not including the fuel oil additive (A)).

Thus, according to a fifth aspect, the present invention provides a method for reducing the wear rate in a fuel supply system of a combustion apparatus which employs a middle distillate fuel oil having a sulphur content of less than or equal to 0.2 weight %, based on the total weight of the middle distillate fuel oil, which comprises adding to said fuel oil in an effective minor amount to reduce the wear rate, a minor proportion of said fuel oil additive (A), as defined and identified in the first aspect of the invention.

Suitably, the use of the fourth aspect and/or method of the fifth aspect further includes operating the combustion apparatus. Suitably, the combustion apparatus comprises a spark-ignited or compression-ignited internal combustion engine, suitably a compression-ignited internal combustion engine.

Suitably, it has been found that the fuel oil additive (A) may be used as an additive in combination with an anti-static additive (B) in a middle distillate fuel oil having a sulphur content of 0.2% by weight or less to improve the electrical conductivity of said middle distillate fuel oil.

Thus, according to a sixth aspect, the present invention provides the use of a fuel oil additive (A), as defined and identified in the first aspect, and an anti-static additive (B), as defined and identified herein, as a combination of additives, in an effective minor amount, in a middle distillate fuel oil having a sulphur content of less than or equal 0.2 weight %, based on the total weight of the middle distillate fuel oil, to increase the electrical conductivity of said middle distillate fuel oil.

Thus, according to a seventh aspect, the present invention provides a method of increasing the electrical conductivity of a middle distillate fuel oil having a sulphur content of less than or equal 0.2 weight %, which comprises adding to said fuel oil an effective minor amount of a combination of additives to increase electrical conductivity, wherein the combination of additives comprises fuel oil additive (A), as defined and identified in the first aspect, and an anti-static additive (B), as defined and identified herein.

Suitably, said fuel oil composition including a combination of fuel oil additive (A) and anti-static additive (B), as defined and identified herein, may have an electrical conductivity of greater than or equal to 25, suitably greater than or equal to 30, suitably greater than or equal to 35, suitably greater than or equal to 40, suitably greater than or equal to 45, suitably greater than or equal to 50, $pSm^{-1}$. Measurement of the electrical conductivity of a fuel oil is routine and methods to do so are known to those skilled in the art. Commercial devices such as Emcee™ Digital Conductivity Meter (Model 1152) are available. This device can measure the conductivity of a liquid sample over a range from 0 to 2000 $pSm^{-1}$ to an accuracy of 1 $pSm^{-1}$.

Suitably, it has been found that when the fuel oil additive (A) is used as an additive in combination with an anti-static additive (B) in a middle distillate fuel oil having a sulphur content of 0.2% by weight or less to improve the electrical conductivity of said middle distillate fuel oil, the improvement in electrical conductivity of said middle distillate fuel may remain at a substantially constant level for an extended period of time, for example over a period of 28 days. Suitably, this unexpected technical effect typically manifests after equilibration of the fuel oil composition, for example after 1 day following addition of the combination of additives (A) and (B) to the fuel oil. Suitably, this may permit the provision of a fuel oil composition which not only meets required electrical conductivity specifications but also has a determinable electrical conductivity at a future time point, without the need for initially overdosing the fuel oil with a large excess of the relatively expensive anti-static additive (B).

Thus, according to an eighth aspect, the invention provides the use of a fuel oil additive (A), as defined and identified in the first aspect, and an anti-static additive (B), as defined and identified herein, as a combination of additives, in an effective minor amount, in a middle distillate fuel oil having a sulphur content of less than or equal 0.2 weight %, based on the total weight of the middle distillate fuel oil, to increase the electrical conductivity of said middle distillate fuel oil and maintain the electrical conductivity of said middle distillate fuel oil at a substantially constant level for an extended period of time, such as for a period of 28 days.

Suitably, by "maintain the electrical conductivity of said middle distillate fuel oil at a substantially constant level for an extended period of time" means the measured electrical conductivity, as described herein, of the fuel oil after a 28 day period, following addition of the combination of Additives (A) and (B) to the fuel oil, is at a level of at least 70, suitably at least 75, suitably at least 80, suitably at least 85, suitably at least 90, suitably at least 95, % of the measured conductivity of the fuel oil after a 1 day period following addition of the combination of Additives (A) and (B) to the fuel oil.

Thus, according to a ninth aspect, the invention provides a method of increasing the electrical conductivity of a middle distillate fuel oil having a sulphur content of less than or equal 0.2 weight % and maintaining electrical conductivity of said middle distillate fuel oil at a substantially constant level for an extended period of time (e.g. for 28 days), which comprises adding to said fuel oil an effective minor amount of a combination of additives to increase electrical conductivity, wherein the combination of additives comprises fuel oil additive (A), as defined and identified in the first aspect, and an anti-static additive (B), as defined and identified herein.

Suitably, it has been found that the fuel oil additive (A) may be used as an additive in combination with an anti-static additive (B) in a middle distillate fuel oil having a sulphur content of 0.2% by weight or less to enhance the lubricity performance of said middle distillate fuel oil. Suitably, the use of the sixth and eighth aspects and the method of the seventh and ninth aspects may each independently further include the use of the combination of Additives (A) and (B) to improve the lubricity performance of said middle distillate fuel oil.

Suitably, the use of a combination of said fuel oil additive (A) in combination with an anti-static additive (B) may permit the formulation of a low-sulphur content fuel oil composition having required lubricity specifications, required electrical conductivity specifications, an increased electrical conductivity and/or a substantially constant electrical conductivity level for an extended period of time (e.g. at least 28 days).

Suitably, it has been found, that fuel oil additive (A) may have a relatively low viscosity, particularly when compared to known additive(s), at temperatures below 20° C., suitably at or below 10° C., suitably at or below 5° C., suitably at or below 0° C., suitably at or below −5° C. Suitably the relatively low viscosity of Additive (A) may facilitate ease of use, handleability (e.g. pumping the additive), transportation, storage and treating a fuel oil with the additive, particularly with neat additive, at such temperatures. Suitably, fuel oil additive (A) is suitable for use in a cold climate, e.g. at ambient temperatures of less than 0° C., and it may be supplied neat, or indeed in a highly concentrated form, for addition to a low-sulphur content fuel oil in such cold climates, thereby reducing transportation and storage costs and reducing top-treat rate requirements.

Suitably, the fuel oil additive (A), as defined and identified herein, may have a viscosity of less than or equal to 10000, suitably less than or equal to 9000, suitably less than or equal to 8000, suitably less than or equal to 7000, suitably less than or equal to 6000, cSt when measured at 0° C. Measurement of the viscosity of fuel oil additive (A) at a particular temperature is routine and methods to do so are known to those skilled in the art. Commercial devices such as an Anton Paar SVM 3001 Viscometer with a temperature ramping programme are available.

Suitably, the relative low viscosity of fuel oil additive (A) may further permit, if desired, the provision and use of an additive concentrate comprising a relatively high amount of fuel oil additive (A) on an active ingredient basis and reduced amount of inert diluent compared with additive concentrates including known lubricity additives.

Thus, according to a tenth aspect, there is provided an additive concentrate suitable for use as an additive to a middle distillate fuel oil having a sulphur content of 0.2% by weight, based on the total weight of the fuel oil, the additive concentrate comprising:

(a) a major amount, based on the total mass of additive concentrate, of a fuel oil additive (A), as identified and defined in the first aspect; and, (b) a minor amount, based on the total mass of additive concentrate, of an inert organic solvent.

Suitably, fuel oil additive (A) may be present in an amount of greater than or equal to 60, suitably greater than or equal to 65, suitably greater than or equal to 70, suitably greater than or equal to 75, suitably greater than or equal to 80, mass % on an active ingredient basis based on the total mass of the additive concentrate.

Suitably, the inert organic solvent may be present in an amount of less than or equal to 40, suitably less than or equal to 35, suitably less than or equal to 30, suitably less than or equal to 25, suitably less than or equal to 20, mass % on an active ingredient basis based on the total mass of the additive concentrate. Suitable inert organic solvents are known to those skilled in the art and include hydrocarbon solvents, for example Solvesso™ 100 and 150 and Isopar™ Suitably, the inert organic solvent dissolves, solubilizes or otherwise disperses the fuel oil additive and any other optional components, as defined herein, which may be present in the additive concentrate.

Suitably, the additive concentrate of the tenth aspect may further include an optional antistatic additive (B), as defined and identified herein, present in a minor amount. Suitably, antistatic additive (B), when present, may be present in an amount of less than 10, suitably less than 7.5, suitably less than 5, mass % on an active ingredient basis based on the total mass of the additive concentrate. In an embodiment, the additive concentrate further comprises an anti-static additive (B) present in a minor amount, based on the total mass of the additive concentrate.

Suitably, the additive concentrate may further comprise one or more further optional additive(s) as defined herein, apart from the fuel oil additive (A) and anti-static additive (B), when present, each of which said further optional additive(s) being present in a minor amount, based on the total mass of the concentrate.

Suitably, fuel oil additive (A), as defined in each and every aspect of the invention, may comprise an ester of an alkyl neo-monocarboxylic acid having a total number of from 5 to 30 carbon atoms and an aliphatic acyclic ($C_2$ to $C_{18}$) alkanol having a total number of from 2 to 18 carbon atoms and a total number of from 2 to 8 hydroxyl groups. Suitably, fuel oil additive (A) may include one or more ester groups(s) which ester group(s) is obtainable by reaction of one or more of the available hydroxyl group(s) of said aliphatic acyclic ($C_2$ to $C_{18}$) alkanol with the mono-carboxylic acid functional group (or reactive derivative thereof) of said alkyl neo-monocarboxylic acid(s).

Suitably, fuel oil additive (A) may comprise up to a maximum of 8 ester groups in the molecule wherein each of said ester groups are obtainable by reaction of a separate available hydroxyl group(s) of said aliphatic acyclic ($C_2$ to $C_{18}$) alkanol with the mono-carboxylic acid functional group (or reactive derivative thereof) of said alkyl neo-monocarboxylic acid(s); the aliphatic acyclic ($C_2$ to $C_{18}$) alkanol having a maximum of 8 available hydroxyl groups.

Suitably, fuel oil additive (A) may comprise a single ester group in the molecule which is obtainable by reaction of only one of the available hydroxyl group(s) of said aliphatic acyclic ($C_2$ to $C_{18}$) alkanol with the mono-carboxylic acid functional group (or reactive derivative thereof) of said alkyl neo-monocarboxylic acid (i.e. the fuel oil additive represents a mono-ester). Suitably, fuel oil additive (A) may comprise two ester groups in the molecule wherein each of said two ester groups is obtainable by reaction of two separate available hydroxyl groups of said aliphatic acyclic ($C_2$ to $C_{18}$) alkanol with the mono-carboxylic acid functional group (or reactive derivative thereof) of said alkyl neo-monocarboxylic acid(s) (i.e. the fuel oil additive represents a di-ester). Suitably, fuel oil additive (A) may comprise three ester groups wherein each of said three ester groups is obtainable by reaction of three separate available hydroxyl group of said aliphatic acyclic ($C_2$ to $C_{18}$) alkanol with the mono-carboxylic acid functional group (or reactive derivative thereof) of said alkyl neo-monocarboxylic acid(s) (i.e. the fuel oil additive represents a tri-ester).

In a preferred embodiment of each and every aspect of the invention, fuel oil additive (A) comprises a single ester group in the molecule which is obtainable by reaction of only one of the available hydroxyl group(s) of said aliphatic acyclic ($C_2$ to $C_{18}$) alkanol with the mono-carboxylic acid functional group (or reactive derivative thereof) of said alkyl neo-monocarboxylic acid (i.e. fuel oil additive (A) represents a mono-ester).

Suitably, the alkyl neo-monocarboxylic acid which may be used to obtain fuel oil additive (A), for example by reaction with the aliphatic acyclic ($C_2$ to $C_{18}$) alkanol, has a total number of from 5 to 30 carbon atoms and comprises acetic acid which is substituted at the alpha carbon atom with three alkyl groups (i.e. an α-trialkyl substituted acetic acid wherein the total number of carbon atoms of the three alkyl groups is from 3 to 28). Suitably, the alkyl neo-monocarboxylic acid has a total number of from 5 to 20, suitably from 5 to 14, suitably from 5 to 10, total carbon atoms. Suitable alkyl neo-monocarboxylic acids comprise the α-trialkyl substituted acetic acids such as neo-pentanoic, neo-hexanoic acid, neo-heptanoic acid, neo-octanoic acid, neo-nonanoic acid, neo-decanoic acid and neo-tetradecanoic acid, suitably neo-pentanoic acid and neo-decanoic acid.

In an embodiment, the alkyl neo-monocarboxylic acid comprises the α-trialkyl substituted acetic acid neo-decanoic acid.

Suitably, the aliphatic acyclic ($C_2$ to $C_{18}$) alkanol which may be reacted with the alkyl neo-monocarboxylic acid (or a reactive derivative thereof) to obtain fuel oil additive (A) includes at least one primary hydroxyl functional group. Suitably, the aliphatic acyclic ($C_2$ to $C_{18}$) alkanol does not include a tertiary hydroxyl functional group.

In an embodiment, the aliphatic acyclic ($C_2$ to $C_{18}$) alkanol includes only primary hydroxyl functional groups. Examples of such aliphatic acyclic ($C_2$ to $C_{18}$) alkanols include ethylene glycol; 1,3-propanediol; 1,4-butanediol; pentaerythritol and pentaerythritol derivatives, such as dipentaerythritol and tripentaerythritol; and, trimethylolpropane and trimethylolpropane derivatives such as di-trimethylolpropane.

In an embodiment, the aliphatic acyclic ($C_2$ to $C_{18}$) alkanol includes a combination of one or more primary hydroxyl functional group(s) and one or more secondary hydroxyl functional group(s). Examples of such aliphatic acyclic ($C_2$ to $C_{18}$) alkanols include: alkylene polyols, such as 1,2-propanediol and 1,3-butanediol; glycerol and derivatives of glycerol, such as diglycerol, triglycerol and hexaglycerol.

In a preferred embodiment, the aliphatic acyclic ($C_2$ to $C_{18}$) alkanol which may be reacted with the alkyl neo-monocarboxylic acid (or reactive derivative thereof) to obtain fuel oil additive (A) comprises glycerol and derivatives of glycerol, such as diglycerol, triglycerol and hexaglycerol, especially glycerol.

In more preferred embodiment, fuel additive (A) comprises an ester of neo-decanoic acid and glycerol (i.e. an ester obtainable by reaction of glycerol with neo-decanoic acid or reactive derivative thereof), particularly the monoester of neo-decanoic acid and glycerol. Suitably, such fuel additive (A) may also be obtained by acid catalyzed hydrolysis of the glycidyl ester of neo-decanoic acid.

Thus, according to an eleventh aspect, there is provided a fuel oil additive (A) for use as an additive for a middle distillate fuel oil having a sulphur content of 0.2% by weight or less, wherein the fuel oil additive (A) is as defined and identified herein.

In this specification, the following words and expressions, if and when used, shall have the meanings ascribed below:

Definitions

"Active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or any cognate word. The expression "consists essentially of" permits inclusion of substances not materially affecting the characteristics of the composition to which it applies. The expression "consists of" or cognates means only the stated features, steps, integers components or groups thereof are present to which the expression refers;

"Hydrocarbon fluid" means a hydrocarbon liquid or oil which is soluble, dissolvable, miscible with a fuel oil composition (albeit not necessarily in all proportions);

"Hydrocarbyl group" means a univalent radical that contains hydrogen and carbon atoms only and it is bonded to the remainder of the compound directly via a single carbon atom. The term "hydrocarbyl group" includes "alkyl", "alkenyl" and "allyl" groups. Preferably, the hydrocarbyl group is an aliphatic hydrocarbyl group, more preferably an aliphatic acyclic hydrocarbyl group, such as an aliphatic acylic alkyl or acyclic alkenyl group. The hydrocarbyl group, as defined herein, may be straight or branched chain;

"Alkyl group" means a univalent alkyl radical (i.e. a monovalent hydrocarbyl group containing no double or triple bonds) which is bonded to the remainder of the compound directly via a single carbon atom. The alkyl group may be a straight-chain or a branched-chain. Preferred alkyl group(s) are acyclic alkyl group(s).

"Alkene group" means a univalent alkene radical (i.e. a monovalent hydrocarbyl group containing one or more carbon to carbon double bonds) which is bonded to the remainder of the compound directly via a single carbon atom. The alkene group may be a straight-chain or a branched-chain. Preferred alkene group(s) are acyclic alkene group(s).

"Alkylene" is synonymous with "alkanediyl" and means a bivalent saturated hydrocarbon radical derived from an alkane by removal of a hydrogen atom from two different carbon atoms (i.e. a divalent hydrocarbon radical containing no double or triple bonds); it may be linear or branched-chain.

"Aliphatic acyclic ($C_2$ to $C_{18}$) alkanol having a total number of from 2 to 18 carbon atoms and a total number of from 2 to 8 hydroxyl groups" embraces an alkanol comprising, preferably consisting of, one or more aliphatic acyclic alkyl chain(s) wherein the total number of carbon atoms provided by said one or more alkyl chain(s) is from 2 to 18 and wherein said one or more aliphatic alkyl chain(s) are terminated and/or substituted with hydroxyl functional groups so that the total number of hydroxyl functional groups present in the alkanol is from 2 to 8. Suitably, the aliphatic acyclic ($C_2$ to $C_{18}$) alkanol may be considered to represent a polyol as it includes 2 or more hydroxyl functional groups. A most preferred aliphatic acyclic ($C_2$ to $C_{18}$) alkanol is glycerol;

"Alkyl neo-monocarboxylic acid having a total number of from 5 to 30 carbon atoms" may be defined as acetic acid which is substituted at the alpha carbon atom either with three alkyl groups (an α-trialkyl substituted acetic acid) or with two alkyl groups (an α-dialkyl substituted acetic acid), wherein the total number of carbon atoms present, including that of the mono-carboxylic acid functional group, is from 5 to 30. Preferably, the alkyl neo-monocarboxylic acid comprises acetic acid which is substituted at the alpha carbon atom with three alkyl groups (α-trialkyl substituted acetic acid). A preferred neo-monocarboxylic acid is neo-decanoic acid;

"Anti-static additive" means an additive which is able to dissipate electrostatic charge from a fuel oil, particularly a low-sulphur content fuel oil. Examples of anti-static agents include a two-component mixture of a polysulfone and a polymeric polyamine reaction product as disclosed for example in U.S. Pat. No. 3,917,466. Such antistatic agents are sold as STADIS™ by Innospec;

"Cold climate" refers to a climate where the ambient temperature may be less than or equal to 10° C., suitably less than or equal to 5° C., suitably less than or equal to 0° C., suitably less than or equal to −5° C.

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in a fuel oil composition in all proportions. These do mean, however, that said one or more additive(s) are, for example, soluble or stably dispersible in a fuel oil composition comprising a middle distillate fuel oil having a sulphur content of 0.2% by weight or less. Moreover, the additional incorporation of other additives may also permit incorporation of higher levels of a particular additive(s), if desired;

"major amount" means at least or in excess of 50 mass %, preferably 60 mass % or more, more preferably 70 mass % or more, even more preferably 80 mass % or more, of a composition;

"minor amount" means less than 50 mass %, preferably less than or equal to 40 mass %, more preferably less than or equal to 30 mass %, even more preferably less than or equal to 20 mass %, of a composition;

"effective minor amount" in respect of an additive, means a minor amount of such additive(s) in a fuel oil composition comprising a middle distillate fuel oil having a sulphur content of 0.2% by weight or less so as to provide the desired technical effect;

"obtainable by" or "obtainable from" in respect of a compound means that the title compound may be obtained by or from reaction of the specified reactants but does not exclude obtaining the title compound by an alternative synthetic route;

"ppm" means parts per million by mass, based on the total mass of the composition;

All percentages reported are mass % on an active ingredient basis, i.e. without regard to carrier or diluent oil, unless otherwise stated.

Suitably, it will be understood that various components used, essential as well as optimal and customary, may react under conditions of formulation, storage or use and that the invention also provides the product obtainable or obtained as a result of any such reaction.

Suitably, it is understood that any upper and lower quantity, range and ratio limits set forth herein may be independently combined. Accordingly, any upper and lower quantity, range and ratio limits set forth herein associated with a particular technical feature of the present invention may be independently combined with any upper and lower quantity, range and ratio limits set forth herein associated with one or more other particular technical feature(s) of the present invention. Furthermore, any particular technical feature of the present invention, and all preferred variants thereof, may be independently combined with any other particular technical feature(s), and all preferred variants thereof, irrespective of whether such features are presented as preferred or not.

Suitably, it will be understood that the preferred features of each aspect of the present invention are to be regarded as preferred features of every other aspect of the present invention.

DETAILED DESCRIPTION OF THE INVENTION

Fuel Oil Additive (A)

The fuel oil additive (A) represents an ester of an alkyl neo-monocarboxylic acid, as defined and identified herein, and an aliphatic acyclic ($C_2$ to $C_{18}$) alkanol, as defined and identified herein. The mono-ester is most preferred. Suitably, fuel oil additive (A) may be obtained by an esterification reaction of said alkyl neo-monocarboxylic acid (or reactive derivative thereof) and said aliphatic acyclic ($C_2$ to $C_{18}$) alkanol.

(i) Aliphatic Acyclic ($C_2$ to $C_{18}$) Alkanol

The aliphatic acyclic ($C_2$ to $C_{18}$) alkanol has a total number of from 2 to 18 carbon atoms and a total number of from 2 to 8 hydroxyl functional groups. The aliphatic acyclic ($C_2$ to $C_{18}$) alkanol includes one or more alkyl chains(s), wherein said one or more alkyl chains are terminated and/or substituted with hydroxyl functional groups, so that the total number of hydroxyl functional groups present in the aliphatic acyclic ($C_2$ to $C_{18}$) alkanol is from 2 to 8.

Suitably, the aliphatic acyclic ($C_2$ to $C_{18}$) alkanol may be considered to represent a polyol as it includes 2 or more hydroxyl functional groups.

Suitably, the aliphatic acyclic ($C_2$ to $C_{18}$) alkanol includes at least one primary hydroxyl functional group. In other words, one or more of said alkyl chain(s) of the aliphatic acyclic ($C_2$ to $C_{18}$) alkanol is terminated with at least one primary hydroxyl functional group, i.e. —$CH_2$—OH group.

In some embodiments, the aliphatic acyclic ($C_2$ to $C_{18}$) alkanol may include only primary hydroxyl functional groups, i.e. the aliphatic acyclic ($C_2$ to $C_{18}$) alkanol includes from 2 to 8 hydroxyl functional groups and each of said hydroxyl functional group(s) represents a primary hydroxyl functional group.

Examples of aliphatic acyclic ($C_2$ to $C_{18}$) alkanols having only primary hydroxyl functional groups include: ($C_2$ to $C_{18}$) alkylene glycols, such as ethylene glycol and neopentyl glycol; ($C_2$ to $C_{18}$) alkylene polyols, such as 1,3-propanediol and 1,4-butanediol; polyethylene glycols, such as diethylene glycol and triethylene glycol; pentaerythritol and pentaerythritol derivatives, such as dipentaerythritol and tripentaerythritol; and, trimethylolpropane and trimethylolpropane derivatives such as di-trimethylolpropane.

In alternative embodiments, the aliphatic acyclic ($C_2$ to $C_{18}$) alkanol may include a combination of one or more primary hydroxyl functional group(s) and one or more secondary hydroxyl functional group(s).

Examples of aliphatic acyclic ($C_2$ to $C_{18}$) alkanols which comprise a combination of one or more primary hydroxyl functional group(s) and one or more secondary hydroxyl functional group(s) include: ($C_2$ to $C_{18}$) alkylene polyols, such as 1,2-propanediol and 1,3-butanediol; glycerol and derivatives of glycerol, such as diglycerol, triglycerol and hexaglycerol.

In a preferred embodiment, the aliphatic acyclic ($C_2$ to $C_{18}$) alkanol comprises a combination of one or more primary hydroxyl functional group(s) and one or more secondary hydroxyl functional group(s). Preferably, the aliphatic acyclic ($C_2$ to $C_{18}$) alkanol having a combination of primary and secondary hydroxyl functional groups comprises glycerol and derivatives of glycerol, such as diglycerol, triglycerol and hexaglycerol, especially glycerol.

Suitably, the aliphatic acyclic ($C_2$ to $C_{18}$) alkanol does not include a tertiary hydroxyl functional group.

Suitably, the one or more alkyl chains present in said aliphatic acyclic ($C_2$ to $C_{18}$) alkanol may each independently optionally be interrupted by an oxygen atom. Accordingly, the aliphatic acyclic ($C_2$ to $C_{18}$) alkanol may include one or more oxyalkylenyl moieties, and thus the term "aliphatic acyclic ($C_2$ to $C_{18}$) alkanol" includes aliphatic acyclic ($C_2$ to $C_{18}$) ether-alkanols having a total number of from 2 to 18 carbon atoms and a total number of from 2 to 8 hydroxyl groups. Examples of aliphatic acyclic ($C_2$ to $C_{18}$) ether-alkanols include: derivatives of glycerol, such as diglycerol, triglycerol and hexaglycerol; polyalkylene glycols, such as diethylene glycol, triethylene glycol, dipropylene glycol; derivatives of pentaerythritol, such as dipentaerythritol and tripentaerythritol; and, derivatives of trimethylolpropane such as di-trimethylolpropane.

In a preferred embodiment, each of said one or more alkyl chains present in said aliphatic acyclic ($C_2$ to $C_{18}$) alkanol is not interrupted by an oxygen atom.

Suitably, the aliphatic acyclic ($C_2$ to $C_{18}$) alkanol has a total number of from 2 to 8, preferably 3 to 8, more preferably 3 to 6, more preferably 3 or 4, most preferably 3, hydroxyl functional groups.

The most preferred aliphatic acyclic ($C_2$ to $C_{18}$) alkanol is glycerol.

Suitably, the aliphatic acyclic ($C_2$ to $C_{18}$) alkanol having a total number of from 2 to 18 carbon atoms and a total number of from 2 to 8 hydroxyl groups, which aliphatic acyclic ($C_2$ to $C_{18}$) alkanol optionally includes one or more oxyalkylenyl moieties, may be represented by a compound of formula I:

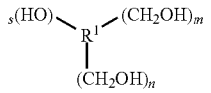

(I)

wherein: $R^1$ represents an aliphatic acyclic alkyl chain having a total number of 1 to 17 carbon atoms, which aliphatic acyclic alkyl chain is optionally interrupted by one or more oxygen atoms; $(CH_2OH)_m$ represents a primary hydroxyl functional group and m is an integer from 1 to 3; $(CH_2OH)_n$ represents a primary hydroxyl functional group and n is an integer from 0 to 3; and, $(OH)_s$ represents a secondary hydroxyl functional group and s is an integer from 0 to 6; and, the sum of m, n and s is an integer from 2 to 8.

It will be appreciated that the aliphatic acyclic ($C_2$ to $C_{18}$) alkanol includes at least one primary hydroxyl functional group(s), i.e. m in a compound of formula I is an integer from 1 to 3, and the total number of hydroxyl functional groups present in a compound of formula I is from 2 to 8.

In some embodiments, the aliphatic acyclic ($C_2$ to $C_{18}$) alkanol includes only primary hydroxyl functional groups, e.g. m and n in a compound of formula I is each independently an integer from 1 to 3 and s is 0. Examples of such aliphatic acyclic ($C_2$ to $C_{18}$) alkanols including only primary hydroxyl functional groups are identified herein.

Suitably, when the aliphatic acyclic ($C_2$ to $C_{18}$) alkanol includes only primary hydroxyl functional groups m and n in a compound of formula I is each independently an integer from 1 to 3, s is zero, and the total number of hydroxyl functional groups present in a compound of formula I is from 2 to 6. In an embodiment, when the aliphatic acyclic ($C_2$ to $C_{18}$) alkanol includes only primary hydroxyl functional groups, the total number of hydroxyl functional groups present in a compound of formula I is 2, e.g. both m and n in a compound of formula I is 1 and s is zero, or m is 2, n and s is zero in a compound of formula I.

In some embodiments, the aliphatic acyclic ($C_2$ to $C_{18}$) alkanol includes a combination of one or more primary hydroxyl functional groups and one or more secondary hydroxyl functional groups, i.e. s in a compound of formula I is an integer from 1 to 6, m in a compound of formula I is an integer from 1 to 3, and n in a compound of formula I is an integer from 0 to 3, such that the total number of hydroxyl functional groups present in a compound of formula I is from 2 to 8.

It is preferred that the aliphatic acyclic ($C_2$ to $C_{18}$) alkanol includes one or more secondary hydroxyl group(s) in addition to said primary hydroxyl functional group(s), i.e. s in a compound of formula I is an integer from 1 to 6, m in a compound of formula I is an integer from 1 to 3, and n in a compound of formula I is an integer from 0 to 3, such that the total number of hydroxyl functional groups present in a compound of formula I is from 2 to 8. Examples of aliphatic acyclic ($C_2$ to $C_{18}$) alkanols having a combination of primary and secondary hydroxyl functional groups are identified herein.

Suitably, when the aliphatic acyclic ($C_2$ to $C_{18}$) alkanol includes a combination of primary and secondary hydroxyl functional groups m and n in a compound of formula I is each independently an integer from 1 to 3, s is an integer from 1 to 6, and the total number of hydroxyl functional groups present in a compound of formula I is from 2 to 8. Preferably, when the aliphatic acyclic ($C_2$ to $C_{18}$) alkanol includes a combination of primary and secondary hydroxyl functional groups m and n in a compound of formula I each represents 1, s is an integer from 1 to 6, and the total number of hydroxyl functional groups present in a compound of formula I is from 3 to 8. More preferably, when the aliphatic acyclic ($C_2$ to $C_{18}$) alkanol includes a combination of primary and secondary hydroxyl functional groups m and n in a compound of formula I each represents 1, s is an integer from 1 to 3, and the total number of hydroxyl functional groups present in a compound of formula I is from 3 to 6. Most preferably, when the aliphatic acyclic ($C_2$ to $C_{18}$) alkanol includes a combination of primary and secondary hydroxyl functional groups m, n and s in a compound of formula I each represents 1 and the total number of hydroxyl functional groups present in a compound of formula Iis 3.

Suitably, $R^1$ in a compound of formula I represents one or more aliphatic acyclic alkyl chain(s) which chain(s) has a total number of from 1 to 17 carbon atoms, and which chain(s) is terminated with one or more primary hydroxyl functional group(s) and optionally substituted with one or more secondary hydroxyl functional group(s), such that the total number of hydroxyl functional groups present in a compound of formula I is from 2 to 8.

Suitably, the one or more aliphatic acyclic alkyl chains which $R^1$ represents may form a single contiguous structure. Thus, $R^1$ may define a linear alkyl chain structure or, where there are sufficient number of carbon atoms, a branched alkyl chain structure. Preferably, $R^1$ represents an aliphatic acyclic alkyl straight chain having from 1 to 17 total carbon atoms.

Suitably $R^1$ may represent an aliphatic acyclic alkyl chain having 1, 2, 3, 4, 5, 6, 7, 8, 9, 10, 11, 12, 13, 14, 15, 16 or 17 carbon atoms in total. Suitably, the aliphatic acyclic alkyl chain which $R^1$ represents may, when there are sufficient number of carbons atoms, be optionally interrupted by one or more oxygen atoms. Preferably, each of said aliphatic acyclic alkyl chain(s) which $R^1$ represents is not interrupted by an oxygen atom.

Suitably, $R^1$ represents an aliphatic acyclic alkyl chain having from 1 to 16, preferably 1 to 12, more preferably 1 to 10, even more preferably 1 to 8, even more preferably 1 to 6, even more preferably 1 to 4, total number of carbon atoms.

Suitably, $R^1$ represents an aliphatic acyclic alkyl straight chain having from 1 to 16, preferably 1 to 12, more preferably 1 to 10, even more preferably 1 to 8, even more preferably 1 to 6, even more preferably 1 to 4, total number of carbon atoms.

Particularly preferred compounds of formula I include compounds wherein:

(i) $R^1$ represents CH; and, m, n and s each represent 1 (i.e. glycerol);

(ii) $R^1$ represents a $C_4$ alkyl straight chain interrupted by a single oxygen atom, m and n each represent 1 and s represents 2 (e.g. diglycerol);

(iii) $R^1$ represents a $C_7$ alkyl straight chain interrupted by two oxygen atoms, m and n each represent 1 and s represents 3 (e.g. triglycerol); and (iv) $R^1$ represents a $C_{16}$ alkyl straight chain interrupted by five oxygen atoms, m and n each represent 1 and s represents 6 (e.g. hexaglycerol).

The most preferred compound of formula I is where $R^1$ represents CH; and, m, n and s each represent 1 (i.e. glycerol).

(ii) Alkyl Neo-Monocarboxylic Acid

The alkyl neo-monocarboxylic acid may be defined as acetic acid which is substituted at the alpha carbon atom either with three alkyl groups (an α-trialkyl substituted acetic acid) or with two alkyl groups (an α-dialkyl substituted acetic acid). Preferably, the alkyl neo-monocarboxylic acid comprises acetic acid which is substituted at the alpha carbon atom with three alkyl groups (α-trialkyl substituted acetic acid).

Suitably, the alkyl neo-monocarboxylic acid has a total number of from 5 to 30, suitably 5 to 20, suitably 5 to 14, suitably 5 to 10, carbon atoms.

The alkyl neo-monocarboxylic acid may be represented by a compound of formula II:

(II)

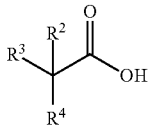

wherein: $R^2$ represents hydrogen or a $C_1$ to $C_{18}$ alkyl group, $R^3$ and $R^4$ each independently represent a $C_1$ to $C_{18}$ alkyl group, and the total number of carbon atoms of $R^2$, $R^3$ and $R^4$ together is from 3 to 28.

Preferably, the alkyl neo-monocarboxylic acid comprises an α-trialkyl substituted acetic acid which may be represented by a compound of formula II, wherein $R^2$ represents a $C_1$ to $C_{18}$ alkyl group, $R^3$ and $R^4$ each independently represent a $C_1$ to $C_{18}$ alkyl group, and the total number of carbon atoms of $R^2$, $R^3$ and $R^4$ together is from 3 to 28.

Suitably, the alkyl group which $R^2$, $R^3$ and $R^4$ may each independently represent in a compound of formula II may be selected from a $C_1$ to $C_{18}$ alkyl group, which alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl and all structural isomers thereof. Suitably, the alkyl group which $R^2$, $R^3$ and $R^4$ may each independently represent may be linear or branched, may be cyclic, part cyclic/acyclic, or acyclic.

Suitably, the alkyl group which $R^2$, $R^3$ and $R^4$ may each independently represent in a compound of formula II comprises a linear or branched acyclic $C_1$ to $C_{18}$ alkyl group. Preferably, the alkyl group which $R^2$, $R^3$ and $R^4$ may each independently represent comprises a linear or branched acyclic $C_1$ to $C_{12}$, more preferably $C_1$ to $C_{10}$, even more preferably $C_1$ to $C_8$, even more preferably $C_1$ to $C_6$, alkyl group.

Suitably, at least one of the alkyl groups which $R^2$, $R^3$ and $R^4$ may each independently represent in a compound of formula II comprises a branched acyclic $C_1$ to $C_{12}$, more preferably $C_1$ to $C_{10}$, even more preferably $C_1$ to $C_8$, even more preferably $C_1$ to $C_6$, alkyl group.

Suitably, the total number of carbon atoms of $R^2$, $R^3$ and $R^4$ together in a compound of formula II is from 3 to 18, more preferably from 3 to 12, even more preferably from 3 to 8.

The most preferred alkyl neo-monocarboxylic acid is neo-decanoic acid which may be represented by a compound of formula II, wherein $R^2$, $R^3$ and $R^4$ are as defined for a compound of formula II and $R^2$, $R^3$ and $R^4$ together in a compound of formula II is 8.

Suitable alkyl neo-monocarboxylic acids comprise the α-trialkyl substituted acetic acids such as neo-pentanoic, neo-hexanoic acid, neo-heptanoic acid, neo-octanoic acid, neo-nonanoic acid, neo-decanoic acid and neo-tetradecanoic acid, preferably neo-pentanoic acid, neo-nonanoic acid and neodecanoic acid, especially neo-decanoic acid.

Suitably, the alkyl-neo-monocarboxylic acid comprises a compound of formula II wherein: $R^2$ represents methyl or ethyl; $R^3$ represents $C_1$ to $C_4$ acyclic alkyl group; $R^4$ represents $C_1$ to $C_{10}$ acyclic alkyl group; and, the total number of carbon atoms of $R^2$, $R^3$ and $R^4$ together is from 3 to 16. Preferably, the alkyl-neo-monocarboxylic acid comprises a compound of formula II wherein: $R^2$ represents methyl or ethyl; $R^3$ represents $C_1$ to $C_4$ acyclic alkyl group; $R^4$ represents $C_1$ to $C_6$ acyclic alkyl group; and, the total number of carbon atoms of $R^2$, $R^3$ and $R^4$ together is from 3 to 12. More preferably, the alkyl-neo-monocarboxylic acid comprises a compound of formula II wherein: $R^2$ represents methyl; $R^3$ represents $C_1$ to $C_3$ acyclic alkyl group; $R^4$ represents $C_1$ to $C_6$ acyclic alkyl group; and, the total number of carbon atoms of $R^2$, $R^3$ and $R^4$ together is from 3 to 8, preferably 8.

Suitably, the alkyl neo-monocarboxylic acid(s) as identified herein are commercially available from suppliers such as ExxonMobil Product Solutions (22777 Springwoods Village Parkway Spring, Texas 77389-1425, USA) Chemical and Hexion Inc. Administration (180E Broad Street, Columbus, Ohio 43215, USA). The alkyl neo-monocarboxylic acids may also be prepared by the Koch process from olefins, carbon monoxide and water as described by H. Koch in Brenstaff. Chem. 36, 321 (1955). Further synthetic procedures for preparing the alkyl neo-monocarboxylic acid(s) can be found in UK patents GB 960,011 and GB 998,974, and U.S. Pat. No. 3,349,107.

Suitably, the fuel oil additive which comprises an ester of an alkyl neo-monocarboxylic acid, as defined and identified herein, and an aliphatic acyclic ($C_2$ to $C_{18}$) alkanol, as defined and identified herein, may be represented by a compound of formula III:

(III)

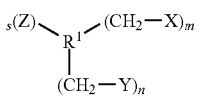

wherein: $R^1$, m, n an s are as defined for a compound of formula 1;

X, Y and Z each independently represent an alkyl neo-monocarboxylic acid moiety of formula IV:

(IV)

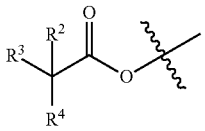

$R^2$, $R^3$, and $R^4$ are each as defined for a compound of formula II.

Suitably, preferred additive compounds of formula III comprise additive compounds derived from glycerol and may be represented by compounds of formulae IIIA, IIIB, IIIC, MID and IIIE:

(IIIA)

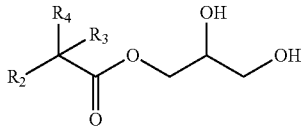

(IIIB)

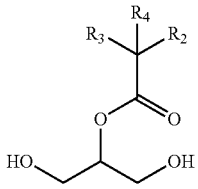

(IIIC)

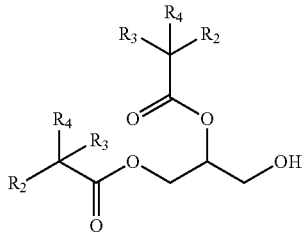

(IIID)

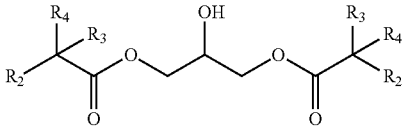

(IIIE)

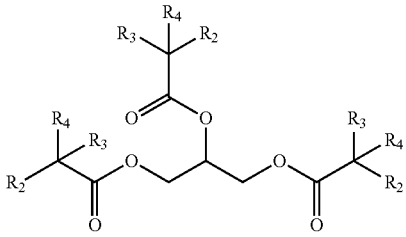

wherein $R^2$, $R^3$, and $R^4$ are each as defined for a compound of formula II.

Suitably, in the compounds of formulae IIIA, IIIB, IIIC, IIID and IIIE, $R^2$ represents methyl or ethyl; $R^3$ represents $C_1$ to $C_4$ acyclic alkyl group; $R^4$ represents $C_1$ to $C_{10}$ acyclic alkyl group; and, the total number of carbon atoms of $R^2$, $R^3$ and $R^4$ together is from 3 to 16. Suitably, in the compounds of formulae IIIA, IIIB, IIIC, IIID and IIIE, $R^2$ represents methyl or ethyl; $R^3$ represents $C_1$ to $C_4$ acyclic alkyl group; $R^4$ represents $C_1$ to $C_6$ acyclic alkyl group; and, the total number of carbon atoms of $R^2$, $R^3$ and $R^4$ together is from 3 to 12. Suitably, in the compounds of formulae IIIA, IIIB, IIIC, IIID and IIIE, $R^2$ represents methyl; $R^3$ represents $C_1$ to $C_3$ acyclic alkyl group; $R^4$ represents $C_1$ to $C_6$ acyclic alkyl group; and, the total number of carbon atoms of $R^2$, $R^3$ and $R^4$ together is from 3 to 8. It is preferred in the compounds of formulae IIIA, IIIB, IIIC, IIID and IIIE that the total number of carbon atoms of $R^2$, $R^3$ and $R^4$ together is 8.

Suitably, the fuel oil additive preferably comprises the monoester and compounds of formulae IIIA and IIIB are particularly preferred fuel oil additives, especially compounds of formula IIIB.

(iii) Preparation of Fuel Oil Additive (a)

The fuel oil additive may be synthesized by standard chemical esterification techniques well known to those skilled in the art and exemplified herein. For example, the alkyl neo-monocarboxylic acid may be converted to an activated acid derivative, e.g. converted to the corresponding acid halide, and the activated acid derivative subsequently condensed with the appropriate aliphatic acyclic ($C_2$ to $C_{18}$) alkanol.

A preferred synthetic route for preparing the fuel oil additive comprises converting the alkyl neo-monocarboxylic acid to the corresponding glycidyl ester derivative, for example by reacting the alkyl neo-monocarboxylic acid with epichlorohydrin (see for example US 2014/0316030A), and then subsequent acid catalysed hydrolysis of the epoxide ring to form the glycerol ester derivative.

It will be appreciated, and common general knowledge to those skilled in the art, that various protection and deprotection group strategies may be employed during the synthetic procedures to maximize the yield of the target ester obtained from the appropriate aliphatic acyclic ($C_2$ to $C_{18}$) alkanol and alkyl neo-monocarboxylic acid.

Antistatic Additive (B)

Suitably, the anti-static additive (B) comprises an olefin polysulfone and a polymeric polyamine reaction product of epichlorohydrin and an aliphatic primary monoamine or an N-aliphatic hydrocarbyl alkylene diamine, or the sulfonic acid salt of the polymeric polyamine reaction product.

Suitably, the weight average molecular weight of the polysulfone is in the range of 10,000 to 1,500,000, suitably in the range of 50,000 to 900,000, for example 100,000 to 500,000.

Suitably the weight ratio of polysulfone component to polymeric polyamine component is in the range of 100:1 to 1:100.

Suitably, the olefins useful for the preparation of the polysulfones have from 6 to 20 carbon atoms, suitably 6 to 18 carbon atoms. Particularly preferred is 1-decene polysulfone. The preparation of these materials is known in the art as described for example in U.S. Pat. No. 3,917,466.

The polymeric polyamine component may be prepared by heating an amine with epichlorohydrin in a molar proportion in the range of 1:1 to 1:1.5 and at a temperature of 50° C. to 100° C. Suitable aliphatic primary amines have from 8 to 24 carbon atoms, suitably from 8 to 12 carbon atoms. The aliphatic group is preferably an alkyl group. If an N-aliphatic hydrocarbyl alkylene diamine is used suitably the aliphatic hydrocarbyl group will have from 8 to 24 carbon atoms and will preferably be an alkyl group. Suitably the alkylene group will have 2 to 6 carbon atoms. The preferred N-aliphatic hydrocarbyl alkylene diamine is an N-aliphatic hydrocarbyl 1,3-propylenediamine. These materials are commercially available, one preferred example being the polymeric reaction product of N-tallow-1,3-propylene diamine with epichlorohydrin. Preferably the polymeric polyamine reaction product will have a degree of polymerisation of about 2 to 20. These materials are also described in U.S. Pat. No. 3,917,466.

Suitably, the polymeric polyamine reaction product is in the form of a sulfonic acid salt. Useful are oil-soluble sulfonic acids such as alkane sulfonic acids or aryl sulphonic acids. A preferred example is dodecyl benzene sulphonic acid.

The anti-static additive (B) is most preferably the commercial product STADIS® 450 available from Innospec Inc., which the applicants understand and intend to be described by the foregoing definition of component (B). STADIS® 425, which is believed to be a diluted version of STADIS® 450 is also suitable.

Suitably, other antistatic additive(s) B include for example Cestoil Northshore ST 3425, Dorf Ketal SR 1795 and Afton AvGuard SDA which are each believed to contain sulfonic acid compounds, such as dodecylbenzene sulfonic acid or dinonylnaphthalene sulfonic acid.

Suitably, the weight:weight ratio of the fuel additive (A) to the anti-static additive (B) in the fuel oil composition is from 5:1 to 1000:1, preferably from 50:1 to 500:1, for example from 100:1 to 500:1.

Fuel Oil Additive Composition

As discussed herein, the fuel oil additive finds utility in low-sulphur content fuel oils. Advantageously, the fuel oil additive typically exhibits a desirable low viscosity, especially at low ambient temperatures (e.g. at or below 0° C.), which may facilitate addition of neat additive direct to a low-sulphur content fuel oil, particularly at such low ambient temperatures. Accordingly, the fuel oil additive may be supplied neat, or indeed in a highly concentrated form, for addition to a low-sulphur content fuel oil, thereby reducing transportation costs associated with the supply of the additive and reducing top-treat rate requirements.

If convenient, the fuel oil additive may be in the form of an additive composition (referred to as an additive concentrate). The additive composition may additionally comprise an inert organic liquid which acts to dissolve, solubilize or otherwise disperse the components of the additive composition. The resulting additive composition may be more convenient to use or store and may be easier to meter into fuel oil. Suitable inert organic liquids include hydrocarbon solvents such as naphtha, kerosene, diesel and heater oil, aromatic hydrocarbons such as those sold under the 'SOLVESSO' trade name, alcohols, ethers and other oxygenates and paraffinic hydrocarbons such as hexane, pentane and isoparaffins. The organic liquid should be miscible with the fuel oil in the sense that it is capable of being physically mixed with fuel oil to form either a solution or a dispersion in the fuel oil. The liquid will be chosen having regard to its compatibility with both the additive composition and the fuel oil in question, and is a matter of routine choice for one skilled in the art. Suitably, the additive composition may suitably comprise less than 50, typically lees than 40, suitably less than 30, suitably less than 20, mass % by of inert organic liquid, the remainder being the fuel oil additive (A) and optionally antistatic additive (B) and any additional optional additives required to fulfill different purposes within the fuel oil. Some optional additional additives are described hereinbelow.

Low-Sulphur Content Fuel Oil

The fuel oil may be a petroleum-based fuel oil, especially a middle distillate fuel oil. Such distillate fuel oils generally boil within the range of from 110° C. to 500° C., e.g. 150° C. to 400° C. The invention is applicable to middle distillate fuel oils of all types, including the distillates having a 90%–20% boiling temperature difference, as measured in accordance with ASTM D-86, of 50° C. or more.

The fuel oil may comprise atmospheric distillate or vacuum distillate, cracked gas oil, or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or may also contain vacuum gas oil or cracked gas oil or both. The fuels may also contain major or minor amounts of components derived from the Fischer-Tropsch process. Fischer-Tropsch fuels, also known as FT fuels, include those that are described as gas-to-liquid fuels, coal and/or biomass conversion fuels. To make such fuels, syngas ($CO+H_2$) is first generated and then converted to normal paraffins and olefins by a Fischer-Tropsch process. The normal paraffins may then be modified by processes such as catalytic cracking/reforming or isomerisation, hydrocracking and hydroisomerisation to yield a variety of hydrocarbons such as iso-paraffins, cyclo-paraffins and aromatic compounds. The resulting FT fuel can be used as such or in combination with other fuel components and fuel types such as those mentioned in this specification.

The invention is also applicable to fuel oils containing fatty acid alkyl esters made from oils derived from animal or vegetable materials, often called biofuels or biodiesels. Biofuels are believed by some to be less damaging to the environment on combustion and are obtained from a renewable source. Other forms of biofuels are also included in the invention such as hydrogenated vegetable oil (HVO) and oil derived from alternative sources such as algae.

Animal or vegetable sources of suitable oils are rapeseed oil, canola oil, coriander oil, soyabean oil, cottonseed oil, sunflower oil, castor oil, olive oil, peanut oil, maize oil, almond oil, palm kernel oil, coconut oil, mustard seed oil, jatropha oil, beef tallow and fish oils. Further examples include fuel oils derived from corn, jute, sesame, shea nut, ground nut and linseed oil and may be derived therefrom by methods known in the art. Rapeseed oil, which is a mixture of fatty acids partially esterified with glycerol is available in large quantities and can be obtained in a simple way by pressing from rapeseed. Recycled oils such as used kitchen oils are also suitable.

As alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 wt % methyl esters of fatty acids with 16 to 22 carbon atoms and 1, 2 or 3 double bonds. The preferred alkyl esters of fatty acids are the methyl esters of oleic acid, linoleic acid, linolenic acid and erucic acid.

Commercial mixtures of the stated kind are obtained for example by cleavage and esterification of animal and vegetable fats and oils by their transesterification with lower (ca. $C_1$ to $C_6$) aliphatic alcohols. For production of alkyl esters of fatty acids it is advantageous to start from fats and oils which contain low levels of saturated acids, less than 20%, and which have an iodine number of less than 130. Blends of the following esters or oils are suitable, e.g. rapeseed, sunflower, canola, coriander, castor, soyabean, peanut, cotton seed, beef tallow etc. Alkyl esters of fatty acids based on certain varieties of rapeseed oil having more than 80 wt % of unsaturated fatty acids with 18 carbon atoms, are particularly suitable.

Whilst all of the above biofuels may be used as fuel oils in this invention, preferred are vegetable oil derivatives, of which particularly preferred biofuels are alkyl ester derivatives of rapeseed oil, cottonseed oil, soyabean oil, sunflower oil, olive oil, or palm oil, rapeseed oil methyl ester being especially preferred. Such fatty acid methyl esters are often referred to in the art as FAME.

Biofuels are commonly used in combination with petroleum-derived fuel oils. The present invention is also applicable to mixtures of biofuel and petroleum-derived fuels in any ratio. Such fuels are often termed "Bx" fuels where x represents the percentage by weight of biofuel in the biofuel-petroleum blend. Examples include fuels where x is 2 or above, preferably 5 or above, for example up to 10, 25, 50, or 95. Current German legislation is framed around 'B7' biofuels. Preferably the biofuel component in such Bx base fuels comprises fatty acid alkyl esters, most preferably fatty acid methyl esters.

The invention is also applicable to pure biofuels. In one embodiment therefore, the fuel oil comprises essentially 100% by weight of a fuel derived from a plant or animal source, preferably essentially 100% by weight of fatty acid alkyl esters, most preferably fatty acid methyl esters.

Examples of jet fuels include fuels which boil in the temperature range from about 65° C. to about 330° C. and are marketed under designations such as JP-4, JP-5, JP-7, JP-8, Jet A and Jet A-1. JP-4 and JP-5 are specified in the US Military Specification MIL-T-5624-N and JP-8 in the US Military Specification MIL-T-83133-D. Jet A, Jet A-1 and Jet B are specified in ASTM D1655.

The fuel oil, whether petroleum or vegetable or animal-derived, or synthetic has a low sulphur content. Typically, the sulphur content of the fuel will be less than 1000 wppm (parts per million by weight), such as less than 500 wppm. Preferably, the sulphur content of the fuel will be less than 100 wppm, for example, less than 50 wppm, such as less than 20 wppm or less than 10 wppm.

In the untreated (i.e. additive-free) state, such fuel oils will normally have low electrical conductivities, usually less than 10 $pSm^{-1}$, such as around 2-5 $pSm^{-1}$.

In an embodiment, a preferred fuel oil comprises diesel fuel (which includes biodiesel fuel).

The amount of fuel oil additive added to the fuel oil will depend on the inherent electrical conductivity of the fuel oil and the desired target electrical conductivity to be reached. Preferably however, the fuel oil additive is present in the fuel oil in an amount of between 5 and 1000, preferably in an amount of between 5 and 500, more preferably between 5 and 200, parts per million by mass based on the total mass of the fuel oil composition on an active ingredient basis.

As will be understood, the fuel oil additive may be added to the fuel oil in the form of the additive composition (referred to as an additive concentrate) described hereinabove. In this case, the amount of additive composition used will be with regard to the active ingredient (a.i.) content of the fuel oil additive. For example the addition to a fuel oil of 200 ppm by mass of a concentrate which contains 20% by weight of carrier fluid will provide the fuel oil with 160 ppm by mass of fuel oil additive (A) on an active ingredient basis.

Suitably, the present invention provides the use of the fuel oil additive or an additive composition (concentrate) comprising the fuel oil additive to a middle distillate fuel oil having a sulphur content of 0.2% by weight or less.

Further additives commonly added to fuel oils may also be employed together with the fuel oil additive (A). Such further additives may be introduced separately into the fuel oil but may also be combined together in an additive concentrate as described hereinabove. Classes of additives will be known to those skilled in the art and the following examples are not intended to be an exhaustive list.

One class are additives capable of altering the low-temperature properties of fuel oils. Suitable materials are well known and include flow-improvers such as ethylene-unsaturated ester copolymers and terpolymers, for example, ethylene-vinyl acetate copolymers, ethylene-vinyl 2-ethyl hexanoate copolymers and ethylene-vinyl neodecanoate copolymers, ethylene-vinyl acetate-vinyl 2-ethyl hexanoate terpolymers, ethylene-vinyl acetate-vinyl neononanoate terpolymers, ethylene-vinyl acetate-vinyl neodecanoate terpolymers; comb polymers such as fumarate-vinyl acetate copolymers polyacrylate and polymethacrylate polymers, including those containing nitrogen or copolymerised with nitrogen-containing monomers; hydrocarbon polymers such as hydrogenated polybutadiene copolymers, ethylene/1-alkene copolymers, and similar polymers. Also suitable are additives known in the art as wax anti-settling additives (WASA).

Other classes of additives are detergents and dispersants, commonly hydrocarbyl-substituted succinimide species; cetane improvers; metal-containing additives used to improve the regeneration of particulate traps attached to the exhaust systems of some diesel engines; lubricity enhancers; other electrical conductivity improvers; dyes and other markers; and anti-oxidants. The present invention contemplates the addition of such further additives; their application in terms of treat rate being known to those skilled in the art. In a preferred embodiment the additive composition of the invention are combined with, or used in combination with, one or both of an ethylene-unsaturated ester copolymer and a wax anti-settling additive. Particularly preferred ethylene-unsaturated ester copolymers are ethylene-vinyl acetate copolymers ethylene-vinyl acetate-vinyl 2-ethyl hexanoate terpolymers, ethylene-vinyl acetate-vinyl neononanoate terpolymers and ethylene-vinyl acetate-vinyl neodecanoate terpolymers. A particularly preferred wax anti-settling additive is the amide-amine salt formed by the reaction of phthalic anhydride with two molar proportions of di-hydrogenated tallow amine.

The invention further relates to:

1. A fuel oil composition comprising a major amount of a middle distillate fuel oil having a sulphur content of 0.2% by weight or less, and a minor amount of a fuel oil additive comprising:
   (a) an ester of an alkyl neo-monocarboxylic acid having a total number of from 5 to 30 carbon atoms and an aliphatic acyclic ($C_2$ to $C_{18}$) alkanol having a total number of from 2 to 18 carbon atoms and a total number of from 2 to 8 hydroxyl groups, wherein said aliphatic acyclic ($C_2$ to $C_{18}$) alkanol includes one or more alkyl chain(s) and each of said one or more alkyl chain(s) may optionally be interrupted by one or more oxygen atom(s).
2. The composition as paragraphed in paragraph 1, wherein the aliphatic acyclic ($C_2$ to $C_{18}$) alkanol is represented by a compound of formula I:

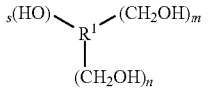

(I)

wherein: $R^1$ represents an aliphatic acyclic alkyl chain having a total number of 1 to 17 carbon atoms, which aliphatic acyclic alkyl chain is optionally interrupted by one or more oxygen atoms; $(CH_2OH)_m$ represents a primary hydroxyl functional group and m is an integer from 1 to 3; $(CH_2OH)_n$ represents a primary hydroxyl functional group and n is an integer from 0 to 3; and, $(OH)_s$ represents a secondary hydroxyl functional group and s is an integer from 0 to 6; and, the sum of m, n and s is an integer from 2 to 8.

3. The composition as paragraphed in paragraph 2, wherein the aliphatic acyclic ($C_2$ to $C_{18}$) alkanol includes only primary hydroxyl functional groups, and both m and n in a compound of formula I is each independently an integer from 1 to 3 and s is 0.
4. The composition as paragraphed in paragraph 3, wherein the aliphatic acyclic ($C_2$ to $C_{18}$) alkanol is selected from ethylene glycol, 1,3-propanediol, 1,4-butanediol, pentaerythritol, dipentaerythritol, tripentaerythritol, trimethylolpropane, and di-trimethylolpropane.
5. The composition as paragraphed in paragraph 2, wherein the aliphatic acyclic ($C_2$ to $C_{18}$) alkanol includes one or more secondary hydroxyl group(s) and one or more primary hydroxyl functional group(s), and s in a compound of formula I is an integer from 1 to 6, m in a compound of formula I is an integer from 1 to 3, and n in a compound of formula I is an integer from 0 to 3.
6. The composition as paragraphed in paragraph 5, wherein both m and n in a compound of formula I each represents 1, s is an integer from 1 to 3, and the total number of hydroxyl functional groups present in a compound of formula I is from 3 to 6.
7. The composition as paragraphed in any one of paragraphs 3 to 5, wherein $R^1$ represents an aliphatic acyclic alkyl straight chain having from 1 to 16, preferably 1 to 12, more preferably 1 to 10, even more preferably 1 to 8, even more preferably 1 to 6, even more preferably 1 to 4, total number of carbon atoms.
8. The composition as paragraphed in any one of paragraphs 3 to 7, wherein the aliphatic acyclic alkyl chain which $R^1$ represents is not interrupted by one or more oxygen atoms.
9. The composition as paragraphed in paragraph 2, wherein the aliphatic acyclic ($C_2$ to $C_{18}$) alkanol represented by a compound of formula I is selected from glycerol, diglycerol, triglycerol and hexaglycerol.
10. The composition as paragraphed in paragraph 9, wherein the aliphatic acyclic ($C_2$ to $C_{18}$) alkanol comprises glycerol.
11. The composition as paragraphed in any one of the preceding paragraphs, wherein the alkyl neo-monocarboxylic acid is represented by a compound of formula II:

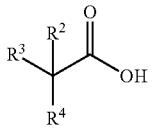

(II)

wherein: $R^2$ represents hydrogen or a $C_1$ to $C_{18}$ alkyl group, $R^3$ and $R^4$ each independently represent a $C_1$ to $C_{18}$ alkyl group, and the total number of carbon atoms of $R^2$, $R^3$ and $R^4$ together is from 3 to 28.

12. The composition as paragraphed in paragraph 10, wherein $R^2$ in a compound of formula II is a $C_1$ to $C_{18}$ alkyl group.

13. The composition as paragraphed in paragraph 11 or 12, wherein $R^2$, $R^3$ and $R^4$ each independently represent at each occurrence a linear or branched acyclic $C_1$ to $C_{12}$, more preferably $C_1$ to $C_{10}$, even more preferably $C_1$ to $C_8$, even more preferably $C_1$ to $C_6$, alkyl group.

14. The composition as paragraphed in any one of paragraphs 11 to 13, wherein at least one of $R^2$, $R^3$ and $R^4$ represents a branched chain alkyl group.

15. The composition as paragraphed in any one of paragraphs 11 to 14, wherein the total number of carbon atoms of $R^2$, $R^3$ and $R^4$ together is from 3 to 8.

16. The composition as paragraphed in paragraph 11 to 15, wherein the alkyl neo-monocarboxylic acid comprises one or more neo-decanoic acids and the total number of carbon atoms of $R^2$, $R^3$ and $R^4$ together is 8.

17. The composition as paragraphed in any one of the preceding paragraphs, wherein the fuel oil additive (A) comprises a compound represented by formula IIIA, IIIB, IIIC, IIID or IIIE, preferably a compound represented by formula IIIA or IIIB, wherein $R^2$, $R^2$ and $R^4$ are each as defined for a compound of formula II in any one of paragraphs 11 to 16:

(IIIA)

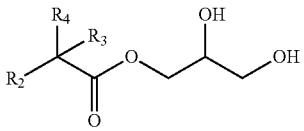

(IIIB)

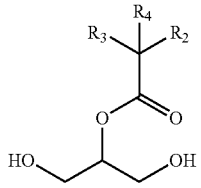

(IIIC)

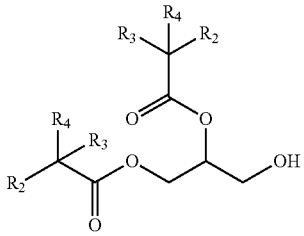

(IIID)

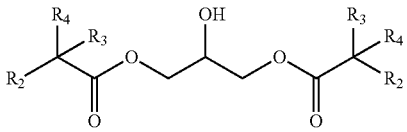

-continued (IIIE)

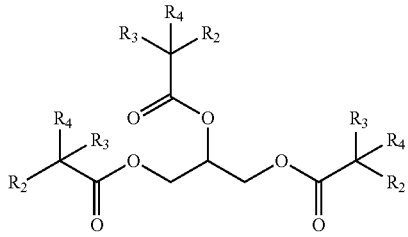

18. The composition as paragraphed in any one of the preceding paragraphs, wherein the fuel oil additive (A) is present in an amount of less than 1000 ppm by mass based on the total mass of the fuel oil composition.

19. The composition as paragraphed in any one of the preceding paragraphs, further including an antistatic additive (B) present in a minor amount, preferably in an amount of less than or equal to 10 ppm by mass based on the total mass of the fuel oil composition.

20. The composition as paragraphed in paragraph 18, wherein the antistatic additive (B) comprises a two-component mixture of a polysulfone and a polymeric polyamine reaction product.

21. The use of a fuel oil additive (A), as defined in any one of paragraphs 1 to 17, as an additive, in an effective minor amount, in a middle distillate fuel oil having a sulphur content of less than or equal 0.2 weight %, based on the total weight of the middle distillate fuel oil, to enhance the lubricity performance of said middle distillate fuel oil.

22. The use of a fuel oil additive (A), as defined in any one of paragraphs 1 to 17, and an anti-static additive (B), as defined in paragraph 18 or 19, as a combination of additives, in an effective minor amount, in a middle distillate fuel oil having a sulphur content of less than or equal 0.2 weight %, based on the total weight of the middle distillate fuel oil, to increase the electrical conductivity of said middle distillate fuel oil and maintain the electrical conductivity of said middle distillate fuel at a substantially constant level for an extended period of time.

23. The use of a fuel oil additive (A), as defined in any one of paragraphs 1 to 17, as an additive, in an effective minor amount, in a middle distillate fuel oil having a sulphur content of less than or equal 0.2 weight %, based on the total weight of the middle distillate fuel oil, to reduce the wear rate in a fuel supply system of a combustion apparatus employing said middle distillate fuel oil.

24. A fuel additive composition for a middle distillate fuel oil having a sulphur content of 0.2% by weight or less, comprising a fuel additive (A) which is a compound represented by formula IIIA, IIIB, IIIC, IIID or IIIE, preferably a compound represented by formula IIIA or IIIB, as defined in paragraph 17.

25. The fuel additive composition as paragraphed in paragraph 23, wherein the composition further includes an inert organic solvent in a minor amount, and wherein fuel Additive (A) is present in a major amount of the composition.

26. The fuel additive composition as paragraphed in paragraph 23 or 24, wherein fuel additive (A) has a viscosity of less than or equal to 10000 cSt when measured at 0° C.

The invention will now be described by way of the following non-limiting examples.

Lubricity Performance Measurement Procedure

The lubricity of a fuel or fuel composition is measured using the High Frequency Reciprocating Rig (HFRR) test in accordance with ISO 12156 (2nd Edition, 2018) using a ball-on-plate reciprocating friction and wear test system available from PCS Instruments Ltd of Stanley Gardens, London. Lubricity performance is reported as average wear scar depth (μm), where a reduced average wear scar indicates improved lubricity performance of a fuel.

Electrical Conductivity Performance Measurement Procedure

The electrical conductivity of a fuel or fuel composition is measured using the Standard Test Method for Electrical Conductivity of Aviation and Distillate Fuels in accordance with ASTM D2624-22 using an Emcee 1152 Digital Conductivity meter available from Emcee Electronics Inc. Conductivity performance is reported as picosiemen per meter ($pSm^{-1}$).

Viscosity Measurement Procedure

The viscosity measurement of an additive at a particular temperature is measured using an Anton Paar SVM 3001 Viscometer with a temperature ramping programme. All measurements are carried out with neat additive sample.

Diesel Fuels and Additives

- Diesel Fuel 1 A low sulphur Swedish Class diesel fuel having the following characteristics: Density 818 kgm-3; Kv (40° C.) 2.04 cSt; Kv (20° C.) 3.07 cSt; Cetane number 51.5; Sulphur less than 0.0003 wt %.
- Diesel Fuel 2 A low sulphur commercial diesel fuel (Carcal) having the following characteristics: Density 832 kgm-3; Kv (40° C.) 3.21 cSt; Kv (20° C.) 5.23 cSt; Cetane number 55.5; Sulphur less than 0.0034 wt %.
- Additive A Known lubricity additive comprising a diglycol ester of dimerized $C_{18}$ oleic acid (U.S. Pat. No. 3,287,273).
- Additive B Glycerol neodecanoate additive synthesized in accordance with Example 2.
- STADIS A static dissipator additive Stadis 450 available from Innospec Inc.

Example 1 Synthesis of Neodecanoic Acid Chloride

Neodecanoic acid (25 g, 0.145 mol) is cooled to 0° C. and thionyl chloride (75 ml, 3 vol), dimethyl formamide (1.165 ml, 0.0145 mol) are added dropwise. The resulting reaction mixture is stirred at room temperature for 4 h. After completion of the reaction, all the volatiles are removed on a rotary evaporator in-vacuo and co-evaporated with toluene (50 mL), to yield the title compound which is used immediately in Example 2 without further purification.

Example 2 Synthesis of Glycerol Neodecanoate (Additive B)

The title compound of Example 1, neodecanoic acid chloride (0.145 mol), is added dropwise to a solution of solketal (18.7 g, 0.142 mol), triethylamine (88 g, 0.87 mol) and DMAP (1.77 g, 0.0145 mol) in dry dichloromethane (125 mL) at 0° C., and the resulting reaction mixture is stirred at room temperature for 16 h. After completion of the reaction (thin layer chromatography (TLC)), the reaction mixture is concentrated under reduced pressure to remove all volatiles, quenched with cold water and then extracted with ethyl acetate (3×300 ml). The combined organic extracts are washed with water (2×500 mL), brine solution (500 mL), dried over sodium sulphate, filtered and concentrated under reduced pressure to yield (2,2-dimethyl-1,3-dioxolan-4-yl)methyl decanoate.

A solution of (2,2-dimethyl-1,3-dioxolan-4-yl)methyl decanoate (42 g, 0.1955 mol) in 80% acetic acid (200 mL) is stirred at 80° C. for 3 h. The reaction mixture is concentrated under reduced pressure and co-evaporated with toluene (2×150 mL). The crude product is purified by column chromatography (silica gel 230-400 mesh: 25-30% ethyl acetate in petroleum ether) to afford the title compound as a pale-yellow liquid (26 g, 68%).

1H-NMR (400 MHZ, DMSO-$d_6$): δ 4.83 (br s, 1H), 4.62 (br s, 1H), 3.82-4.00 (m, 2H), 3.62-3.63 (m, 1H), 3.35-3.37 (m, 2H), 1.24 (m, 4H), 1.12 (m, 2H), 1.04-1.11 (m, 4H), 0.74-0.92 (m, 9H). Mol Formula: $C_{13}H_{26}O_4$, Mol. Weight: 246.35, Mass found: 247.2 (M+1) by LCMS: MM-ES+ APCI.

Example 3 Lubricity Performance

The lubricity performance of Additive A in comparison to Additive B was determined using the Lubricity Performance Measurement Procedure described herein with Diesel Fuel 1. The results are presented in Table 1.

TABLE 1

| Fuel | Concentration of Additive (ppm (a.i.)) | Wear Scar Average (μm) Additive A | Wear Scar Average (μm) Additive B |
|---|---|---|---|
| Diesel Fuel 1 | 0 | 636.25 | 636.25 |
| | 50 | 652 | 604.5 |
| | 100 | 565.8 | 520.75 |
| | 150 | 357.5 | 356.75 |
| | 200 | 360.75 | 401.5 |
| | 250 | 324.25 | 404.5 |
| | 300 | 318.5 | 331.5 |
| | 400 | 314 | 302.75 |
| | 500 | 176 | 298.75 |

The results in Table 1 evidence that Additive B is essentially equally as effective at improving the lubricity of a low sulphur containing diesel fuel as the commercially available Additive A. Further, Additive B exhibits improved performance at a dosage rate of from 50 to 350 ppm (a.i.) compared to Additive A.

Example 4 Electrical Conductivity Performance of Additive B

The electrical conductivity performance of Additive B (Glycerol Neodecanoate) in both Diesel Fuel 1 and Diesel Fuel 2 was determined in the presence of or absence of the static dissipator additive STADIS using the Electrical Conductivity Performance Measurement Procedure described herein. Each experiment was repeated in triplicate and the average electrical conductivity measurement ($pSm^{-1}$) is reported in Table 2.

TABLE 2

| Fuel | STADIS (ppm (a.i.)) | Additive B (ppm (a.i.)) | Average Conductivity ($pSm^{-1}$) |
|---|---|---|---|
| Diesel Fuel 1 | — | — | 1.3 |
| | 1 | — | 157.0 |
| | — | 200 | 2.3 |

TABLE 2-continued

| Fuel | STADIS (ppm (a.i.)) | Additive B (ppm (a.i.)) | Average Conductivity ($pSm^{-1}$) |
|---|---|---|---|
| | 1 | 200 | 109.7 |
| Diesel | — | — | 1.0 |
| Fuel 2 | 1 | — | 97.7 |
| | — | 200 | 1.0 |
| | 1 | 200 | 75.3 |

The results in Table 2 evidence for both Diesel Fuel 1 and Diesel Fuel 2:

Addition of STADIS alone to each diesel fuel provides an improvement in the electrical conductivity of the respective base fuel alone not including an additive.

Addition of Additive B alone to each diesel fuel typically does not significantly affect the electrical conductivity of the respective base fuel alone not including an additive.

Addition of a combination of STADIS and Additive B to each diesel fuel provides an improvement in the electrical conductivity of the base fuel alone not including an additive.

The improved electrical conductivity of each respective diesel fuel including a combination of STADIS and Additive B lies between that achieved by STADIS alone and by Additive B alone but it is significantly greater than the required minimum conductivity limit of 25 $pSm^{-1}$ as specified by ASTM D975.

Example 5 Electrical Conductivity Performance of Combination of STADIS and Additive a or Additive B Over Time The electrical conductivity of Diesel Fuel 1 including a combination of additives comprising: (a) STADIS and Additive A; and, (b) STADIS and Additive B, was measured over a 28 day period to determine what effect, if any, the presence of each respective additive (Additive A or B) had on electrical conductivity of the fuel with respect to time in the presence of a known static dissipator (i.e. STADIS). Each experiment was repeated in triplicate and the average electrical conductivity measurement(s) ($pSm^{-1}$) are reported in Table 3.

TABLE 3

| Fuel | Additive | Treat Rate (a.i. ppm) | Stadis 450 (a.i. ppm) | Day 1 ($pS \cdot m^{-1}$) | Day 28 ($pS \cdot m^{-1}$) | Relative Decrease (% relative to day 1) |
|---|---|---|---|---|---|---|
| Diesel | 0 | 0 | 1 | 120.33 | 84 | 30.19% |
| Fuel 1 | 0 | 0 | 3 | 434 | 355.33 | 18.13% |
| | Additive A | 200 | 1 | 120.33 | 63.67 | 47.09% |
| | | 200 | 3 | 441.67 | 274.67 | 37.81% |
| | | 400 | 1 | 91.67 | 42.67 | 53.45% |
| | | 400 | 3 | 386.67 | 186 | 51.90% |
| | Additive B | 200 | 1 | 77.67 | 75.33 | 3.01% |
| | | 200 | 3 | 328 | 323.33 | 1.42% |
| | | 400 | 1 | 82.33 | 74.33 | 9.72% |
| | | 400 | 3 | 261.67 | 256 | 2.17% |

The results in Table 3 evidence the following:

In the presence of STADIS alone the electrical conductivity of the fuel decreases over 28 days (i.e. the effectiveness of STADIS decreases with time). Further, the observed relative decrease in conductivity of the fuel is dependent upon the initial concentration of STADIS present in the fuel. A 30% decrease in relative conductivity of the fuel over 28 days is observed when the fuel is treated with an initial STADIS concentration of 1 ppm, whereas a lower 18% decrease in relative conductivity of the fuel over 28 days is observed when the fuel is treated with a higher initial STADIS concentration of 3 ppm.

When Additive A is used in combination with STADIS, the presence of Additive A does not significantly affect the initial electrical conductivity of the fuel after Day 1 compared with a comparable fuel including STADIS alone. However, with time (e.g. after a 28 day period), the presence of Additive A in combination with STADIS further significantly reduces the electrical conductivity of the fuel compared with a comparable fuel including STADIS alone (i.e. the presence of Additive A has a significant negative impact on the effectiveness of STADIS with time). Further, this significant negative impact on the effectiveness of STADIS with time due to the presence of Additive A is dependent upon the initial concentration of Additive A in the fuel. A higher initial concentration of Additive A in the fuel results in a larger decrease in electrical conductivity of the fuel with time (e.g. after 28 days) compared with a comparable fuel including a lower initial concentration of Additive A. Accordingly, when Additive A is used as a lubricity improver in combination with STADIS, then it is typically necessary to overtreat the fuel initially with an increased amount of the expensive STADIS additive so as to maintain the electrical conductivity of the fuel within required specification limits after a specified time period (e.g. after 28 days).

When Additive B is used in combination with STADIS, the presence of Additive B results in a relatively minor decrease in the initial electrical conductivity of the fuel after Day 1 compared with a comparable fuel including STADIS alone. However with time (e.g. after a 28 day period), and completely unexpectedly, when Additive B is used in combination with STADIS, the presence of Additive B essentially stabilises the electrical conductivity of the fuel compared with either a comparable fuel including STADIS alone or a comparable fuel including a combination of Additive A and STADIS. Accordingly, the use of Additive B in combination with STADIS not only allows the electrical conductivity of the fuel to be improved compared to the untreated fuel alone but also enables the electrical conductivity of the treated fuel to be maintained at an essentially constant level with time (e.g. after 28 days). Suitably, this provides certainty for a fuel formulator and it enables the formulator to provide a fuel having required, and essentially stable, electrical conductivity specifications, without the need for overdosing the fuel with a relatively high initial dosage of the expensive STADIS additive.

Example 6 Viscosity Measurements of Additive a Versus Additive B

The viscosity of Additive B (Glycerol Neodecanoate) and known Additive A was determined at different temperatures using the Viscosity Measurement Procedure described herein. The viscosity measurements (cSt) are reported in Table 4.

TABLE 4

| Additive | Temperature (° C.) | Viscosity (cSt) |
|---|---|---|
| Additive A | 60 | 456.0 |
| | 50 | 771.3 |
| | 40 | 1374.4 |
| | 30 | 2807.9 |
| | 20 | 6107.0 |
| | 10 | 14971 |
| | 5 | 24702 |
| | 0 | Unmeasurable - too viscous |
| Additive B | 60 | 40.311 |
| | 50 | 69.0 |
| | 40 | 131.7 |
| | 30 | 278.2 |
| | 20 | 672.0 |
| | 10 | 1856.4 |
| | 5 | 3303.3 |
| | 0 | 5660.2 |

The results in Table 4 evidence the following:

Additive B has a significantly lower viscosity than Additive A at each respective temperature point.

The viscosity of Additive A increases significantly with a corresponding decrease in temperature. Additive A remains handleable at 20° C. However, significant handleability problems with Additive A arise at temperatures less than 20° C., especially less than or equal to 10° C., due to a significant increase in viscosity of Additive A. At 0° C. Additive A is too viscous to measure.

The viscosity of Additive B, in comparison to Additive A, increases much less with a corresponding decrease in temperature. Additive B remains handleable at temperatures of 0° C. and below.

The viscosity of Additive B at 0° C. is less than the viscosity of Additive A at 20° C., evidencing that it is easier to handle (e.g. pump, dispense, transport) Additive B at 0° C. than Additive A at 20° C.

The lower viscosity of Additive B at low temperature compared with Additive A means Additive B is more suited for use in cold climates than Additive A. Suitably, Additive B may be supplied neat, Additive B is easier to transport and/or store and/or dose a fuel, in cold climates, especially climates with a low ambient temperature of −5° C. and below.

All documents described herein are incorporated by reference herein, including any priority documents and/or testing procedures, to the extent they are not inconsistent with this text.

What is claimed is:

1. A fuel oil composition comprising a major amount of a middle distillate fuel oil having a sulphur content of 0.2% by weight or less, and a minor amount of a fuel oil additive (A) comprising:

an ester of an alkyl neo-monocarboxylic acid having a total number of from 5 to 30 carbon atoms, and an aliphatic acyclic ($C_2$ to $C_{18}$) alkanol having a total number of from 2 to 18 carbon atoms and a total number of from 2 to 8 hydroxyl groups, wherein said aliphatic acyclic ($C_2$ to $C_{18}$) alkanol includes one or more alkyl chain(s) and each of said one or more alkyl chain(s) may optionally be interrupted by one or more oxygen atom(s).

2. The composition as claimed in claim 1, wherein the aliphatic acyclic ($C_2$ to $C_{18}$) alkanol is represented by a compound of formula I:

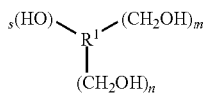

(I)

wherein: $R_1$ represents an aliphatic acyclic alkyl chain having a total number of 1 to 17 carbon atoms, which aliphatic acyclic alkyl chain is optionally interrupted by one or more oxygen atoms; $(CH_2OH)_m$ represents a primary hydroxyl functional group and m is an integer from 1 to 3; $(CH_2OH)_n$ represents a primary hydroxyl functional group and n is an integer from 0 to 3; and, $(OH)_s$ represents a secondary hydroxyl functional group and s is an integer from 0 to 6; and, the sum of m, n and s is an integer from 2 to 8.

3. The composition as claimed in claim 2, wherein the aliphatic acyclic ($C_2$ to $C_{18}$) alkanol includes only primary hydroxyl functional groups, and both m and n in a compound of formula I is each independently an integer from 1 to 3 and s is 0.

4. The composition as claimed in claim 3, wherein the aliphatic acyclic ($C_2$ to $C_{18}$) alkanol is selected from ethylene glycol, 1,3-propanediol, 1,4-butanediol, pentaerythritol, dipentaerythritol, tripentaerythritol, trimethylolpropane, and di-trimethylolpropane.

5. The composition as claimed in claim 2, wherein the aliphatic acyclic ($C_2$ to $C_{18}$) alkanol includes one or more secondary hydroxyl group(s) and one or more primary hydroxyl functional group(s), and s in a compound of formula I is an integer from 1 to 6, m in a compound of formula I is an integer from 1 to 3, and n in a compound of formula I is an integer from 0 to 3.

6. The composition as claimed in claim 5, wherein both m and n in a compound of formula I each represents 1, s is an integer from 1 to 3, and the total number of hydroxyl functional groups present in a compound of formula I is from 3 to 6.

7. The composition as claimed in claim 3, wherein $R^1$ represents an aliphatic acyclic alkyl straight chain having from 1 to 16 total number of carbon atoms.

8. The composition as claimed in claim 5, wherein $R^1$ represents an aliphatic acyclic alkyl straight chain having from 1 to 16 total number of carbon atoms.

9. The composition as claimed in claim 3, wherein the aliphatic acyclic alkyl chain which $R^1$ represents is not interrupted by one or more oxygen atoms.

10. The composition as claimed in claim 5, wherein the aliphatic acyclic alkyl chain which $R^1$ represents is not interrupted by one or more oxygen atoms.

11. The composition as claimed in claim 7, wherein the aliphatic acyclic alkyl chain which $R^1$ represents is not interrupted by one or more oxygen atoms.

12. The composition as claimed in claim 8, wherein the aliphatic acyclic alkyl chain which $R^1$ represents is not interrupted by one or more oxygen atoms.

13. The composition as claimed in claim 2, wherein the aliphatic acyclic ($C_2$ to $C_{18}$) alkanol represented by a compound of formula I is selected from glycerol, diglycerol, triglycerol and hexaglycerol.

14. The composition as claimed in claim 13, wherein the aliphatic acyclic ($C_2$ to $C_{18}$) alkanol comprises glycerol.

15. The composition as claimed in claim 1, wherein the alkyl neo-monocarboxylic acid is represented by a compound of formula II:

(II)

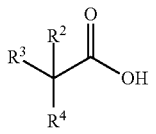

wherein: $R^2$ represents hydrogen or a $C_1$ to $C_{18}$ alkyl group, $R^3$ and $R^4$ each independently represent a $C_1$ to $C_{18}$ alkyl group, and the total number of carbon atoms of $R^2$, $R^3$ and $R^4$ together is from 3 to 28.

16. The composition as claimed in claim 15, wherein $R^2$ in a compound of formula II is a $C_1$ to $C_{18}$ alkyl group.

17. The composition as claimed in claim 15, wherein $R^2$, $R^3$ and $R^4$ each independently represent at each occurrence a linear or branched acyclic $C_1$ to $C_{12}$ alkyl group.

18. The composition as claimed in claim 15, wherein at least one of $R^2$, $R^3$ and $R^4$ represents a branched chain alkyl group.

19. The composition as claimed in claim 15, wherein the total number of carbon atoms of $R^2$, $R^3$ and $R^4$ together is from 3 to 8.

20. The composition as claimed in claim 15, wherein the alkyl neo-monocarboxylic acid comprises one or more neodecanoic acids and the total number of carbon atoms of $R^2$, $R^3$ and $R^4$ together is 8.

21. The composition as claimed in claim 1, wherein the fuel oil additive (A) comprises a compound represented by formula IIIA, IIIB, IIIC, IIID or IIIE:

(IIIA)

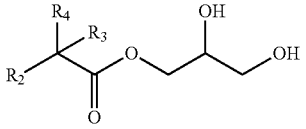

(IIIB)

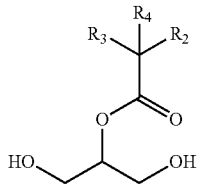

-continued (IIIC)

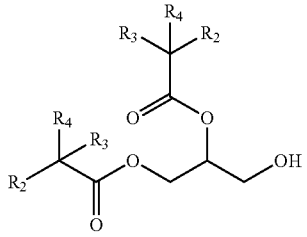

(IIID)

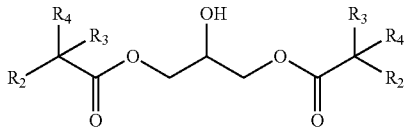

(IIIE)

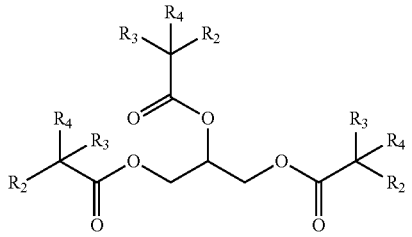

wherein $R^2$ represents hydrogen or a $C_1$ to $C_{18}$ alkyl group, $R^3$ and $R^4$ each independently represent a $C_1$ to $C_{18}$ alkyl group, and the total number of carbon atoms of $R^2$, $R^3$ and $R^4$ together is from 3 to 28.

22. The composition as claimed in claim 1, wherein the fuel oil additive (A) is present in an amount of less than 1000 ppm by mass based on the total mass of the fuel oil composition.

23. The composition as claimed in claim 1, further including an antistatic additive (B) present in a minor amount based on the total mass of the fuel oil composition.

24. The composition as claimed in claim 23, wherein the antistatic additive (B) comprises a two-component mixture of a polysulfone and a polymeric polyamine reaction product.

25. A method comprising using a fuel oil additive (A) as an additive, in an effective minor amount, in a middle distillate fuel oil having a sulphur content of less than or equal 0.2 weight %, based on the total weight of the middle distillate fuel oil, to enhance the lubricity performance of said middle distillate fuel oil, wherein the a fuel oil additive (A) comprises:

an ester of an alkyl neo-monocarboxylic acid having a total number of from 5 to 30 carbon atoms, and an aliphatic acyclic ($C_2$ to $C_{18}$) alkanol having a total number of from 2 to 18 carbon atoms and a total number of from 2 to 8 hydroxyl groups, wherein said aliphatic acyclic ($C_2$ to $C_{18}$) alkanol includes one or more alkyl chain(s) and each of said one or more alkyl chain(s) may optionally be interrupted by one or more oxygen atom(s).

26. A method comprising using a fuel oil additive (A) and an anti-static additive (B) as a combination of additives, in an effective minor amount, in a middle distillate fuel oil having a sulphur content of less than or equal 0.2 weight %, based on the total weight of the middle distillate fuel oil, to increase the electrical conductivity of said middle distillate fuel oil and maintain the electrical conductivity of said middle distillate fuel at a substantially constant level for an extended period of time, wherein the fuel oil additive (A) comprises:

an ester of an alkyl neo-monocarboxylic acid having a total number of from 5 to 30 carbon atoms, and an aliphatic acyclic ($C_2$ to $C_{18}$) alkanol having a total number of from 2 to 18 carbon atoms and a total number of from 2 to 8 hydroxyl groups, wherein said aliphatic acyclic ($C_2$ to $C_{18}$) alkanol includes one or more alkyl chain(s) and each of said one or more alkyl chain(s) may optionally be interrupted by one or more oxygen atom(s).

27. A method comprising using the fuel oil additive (A) as an additive, in an effective minor amount, in a middle distillate fuel oil having a sulphur content of less than or equal 0.2 weight %, based on the total weight of the middle distillate fuel oil, to reduce the wear rate in a fuel supply system of a combustion apparatus employing said middle distillate fuel oil, wherein the fuel oil additive (A) comprises:

an ester of an alkyl neo-monocarboxylic acid having a total number of from 5 to 30 carbon atoms, and an aliphatic acyclic ($C_2$ to $C_{18}$) alkanol having a total number of from 2 to 18 carbon atoms and a total number of from 2 to 8 hydroxyl groups, wherein said aliphatic acyclic ($C_2$ to $C_{18}$) alkanol includes one or more alkyl chain(s) and each of said one or more alkyl chain(s) may optionally be interrupted by one or more oxygen atom(s).

28. A fuel additive composition for a middle distillate fuel oil having a sulphur content of 0.2% by weight or less, comprising a fuel additive (A) which is a compound represented by formula IIIA, IIIB, IIIC, IIID or IIIE of claim 21.

29. The fuel additive composition as claimed in claim 28, wherein the composition further includes an inert organic solvent in a minor amount, and wherein fuel Additive (A) is present in a major amount of the composition.

30. The fuel additive composition as claimed in claim 28, wherein fuel additive (A) has a viscosity of less than or equal to 10000 cSt when measured at 0° C.

31. The fuel additive composition as claimed in claim 29 wherein fuel additive (A) has a viscosity of less than or equal to 10000 cSt when measured at 0° C.

32. The composition as claimed in claim 3, wherein $R^1$ represents an aliphatic acyclic alkyl straight chain having from 1 to 8 total number of carbon atoms.

33. The composition as claimed in claim 3, wherein $R^1$ represents an aliphatic acyclic alkyl straight chain having from 1 to 4 total number of carbon atoms.

34. The composition as claimed in claim 5, wherein $R^1$ represents an aliphatic acyclic alkyl straight chain having from 1 to 8 total number of carbon atoms.

35. The composition as claimed in claim 5, wherein $R^1$ represents an aliphatic acyclic alkyl straight chain having from 1 to 4 total number of carbon atoms.

36. The composition as claimed in claim 21, wherein the fuel oil additive (A) comprises a compound represented by formula IIIA or IIIB.

37. The composition as claimed in claim 1, further including an antistatic additive (B) present at less than or equal to 10 ppm by mass based on the total mass of the fuel oil composition.

38. The composition as claimed in claim 15, wherein $R^2$, $R^3$ and $R^4$ each independently represent at each occurrence a linear or branched acyclic $C_1$ to $C_6$ alkyl group.

* * * * *